US006854683B2

(12) United States Patent
Hayashi et al.

(10) Patent No.: US 6,854,683 B2
(45) Date of Patent: Feb. 15, 2005

(54) TAPE WINDER

(75) Inventors: Yoichi Hayashi, Odawara (JP); Akihisa Kita, Odawara (JP); Kyohisa Uchiumi, Odawara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 14 days.

(21) Appl. No.: 10/404,328

(22) Filed: Apr. 2, 2003

(65) Prior Publication Data

US 2003/0189124 A1 Oct. 9, 2003

(30) Foreign Application Priority Data

Apr. 4, 2002 (JP) ..... 2002-101959
Apr. 5, 2002 (JP) ..... 2002-103228
Sep. 19, 2002 (JP) ..... 2002-273140

(51) Int. Cl.[7] ..... B65H 23/04

(52) U.S. Cl. ..... 242/548.3; 242/908

(58) Field of Search ..... 242/548, 548.1, 242/548.3, 548.4, 908

(56) References Cited

U.S. PATENT DOCUMENTS 4,789,110 A * 12/1988 Sakaguchi et al. ..... 242/548.4
5,149,005 A * 9/1992 Takagi et al. ..... 242/548
5,547,146 A * 8/1996 Kita ..... 242/548.4
5,865,389 A * 2/1999 Gonzales ..... 242/548.4
6,719,238 B1 * 4/2004 Grant et al. ..... 242/548.4

FOREIGN PATENT DOCUMENTS

JP 6-329308 11/1994

* cited by examiner

*Primary Examiner*—William A. Rivera
(74) *Attorney, Agent, or Firm*—Sughrue Mion, PLLC

(57) ABSTRACT

In the tape winder for winding a tape on a reel to form a tape roll, a nozzle which blows a gas toward an outer peripheral surface of the tape roll at a winding time of the tape is fixed on a slider, which is slidably supported on a rail. In this way, the nozzle is supported movably forward and backward with respect to the tape roll. Moreover, the nozzle is pressed toward the tape roll by an air cylinder with a constant pressing force. Thus, the nozzle is allowed to accurately follow an outer peripheral surface of the tape roll, and a constant pressure can be applied to the outer peripheral surface of the tape roll. Consequently, the tape can be wound with an adequate winding tightness.

25 Claims, 15 Drawing Sheets

TAPE WINDER

BACKGROUND OF THE INVENTION

1. Field of the Invention

The present invention relates to a tape winder and, more in particular, to a winder for winding a long and narrow piece of matter such as a magnetic tape and the like on a winding shaft in a roll shape.

2. Description of the Related Art

Japanese Patent Application Publication No. 6-329308 discloses a tape winder, which comprises a pressure roll rotationally contacting the outer peripheral surface of a tape roll at a winding time, a wind pressure device which blows an air to the outer peripheral surface of the tape roll at the winding time, and a movable portion moving device which displaces the pressure roll and the wind pressure device according to a winding diameter of the tape roll. In this winder, when the wind pressure applied to the tape roll fluctuates, there occur various troubles. For example, when the wind pressure decreases, the air caught between the tape winds increases and there occur troubles in that the tape winding becomes loose and the edges of the wound tape are not aligned. On the contrary, when the wind pressure increases, the winding tightness increases, and an adverse effect is inflicted upon the quality to cause the increase of the winding tightness, a damage on the tape and the like. Thus, it is necessary always to keep a constant control of the distance between a nozzle which is a wind pressure device and the outer peripheral surface of the tape roll so that the wind pressure applied to the outer peripheral surface of the tape roll is kept constant.

As a control method of controlling a distance constant between the nozzle and the outer peripheral surface of the tape roll, there is a method in which a numerical calculation of a winding diameter is made from a tape traveling speed and a number of reel rotations and, according to this calculated winding diameter, a nozzle position is allowed to be moved backward. There is also a method in which the distance between the outer peripheral surface of the tape roll and the nozzle is measured by a laser displacement gage and the like and, according to this measured value, the nozzle position is controlled.

However, the method of making a numerical operation of a winding diameter requires an operation of the winding diameter including an eccentricity quantity of the tape roll at a high speed and, therefore, there is a problem in that not only an expensive high speed operational equipment, but also a complex control system for correcting a nozzle position at a high speed according to calculation results is required. Further, in the case where a fluctuation of a tape thickness is high, the nozzle sometimes contacts the outer peripheral surface of the tape roll, thereby inflicting a damage on it.

On the other hand, the method of measuring a distance requires correcting the nozzle position at a high speed according to a measurement result of the distance between the nozzle and the outer peripheral surface of the tape roll and, therefore, there is a problem in that it becomes difficult for the nozzle to follow the outer peripheral surface of the tape roll according as the number of rotations of a winding reel increases.

Moreover, the conventional tape winder has a drawback in that a mere constant control of the distance between the nozzle and the outer peripheral surface of the tape roll not only causes the edges of the wound tape to be not aligned when the tape is displaced in a width direction at a tape winding approach position immediately before the tape is wound, but also the wind pressure from the nozzle is biased in the width direction, so that the winding tightness becomes not uniform in the width direction of the tape.

SUMMARY OF THE INVENTION

The present invention has been carried out in view of such circumstances, and an object of the invention is to provide a winder capable of allowing a nozzle to surely follow the outer peripheral surface of a tape roll and applying a constant pressure to the outer peripheral surface of the tape roll in order to wind the tape with an adequate tightness.

Another object of the invention is to provide a winder capable of allowing the nozzle to precisely follow the outer peripheral surface of the tape roll by a simple control system in order to wind the tape with a uniform tightness.

Still another object of the invention is to provide a tape winder capable of neatly aligning the edges of the wound tape roll and making the winding tightness uniform in the width direction of the tape.

In order to attain the above-described object, the present invention is directed to tape winder, comprising: a winding shaft which winds a tape to form a tape roll; a nozzle which blows a gas toward an outer peripheral surface of the tape roll at a winding time of the tape; a support device which movably supports the nozzle forward and backward with respect to the outer peripheral surface of the tape roll; and a pressing device which presses the nozzle supported by the support device toward the outer peripheral surface of the tape roll with a constant pressing force, wherein the tape is wound at a position in which a pressing force of the pressing device and a repulsive force in a space between the nozzle and the tape roll are balanced.

According to the present invention, since the nozzle is supported movably forward and backward with respect to the outer peripheral surface of the tape roll and at the same time the nozzle is pressed toward the outer peripheral surface of the tape roll with a constant pressing force, the nozzle automatically moves and stops at a position in which the repulsive force in a space between the outer peripheral surface of the tape roll and the nozzle and the pressing force of the pressing device are balanced. Hence, the nozzle is always kept at a constant distance from the outer peripheral surface of the tape roll and the outer peripheral surface of the tape roll is always given a constant pressure. In this way, the tape can be wound with an adequate winding tightness.

Preferably, the pressing device comprises an air cylinder.

Preferably, the tape winder further comprises a damping device which controls a vibration of the nozzle. Hence, the vibration of the nozzle can be controlled when the repulsive force and the pressing force are balanced.

The damping device may comprise a conductive plate and a magnet; one of the conductive plate and the magnet is provided to move with the nozzle, and the other of the conductive plate and the magnet is fixed adjacent to the one of the conductive plate and the magnet provided to move with the nozzle; and an eddy current is generated in a space between the conductive plate and the magnet with a forward and backward movement of the nozzle so as to control the vibration of the nozzle.

Preferably, a damping by the eddy current is not less than 0.7 in an attenuation ratio. When the attenuation ratio is small, the vibration due to a resonance becomes large and a follow-up deviation value becomes deteriorated; however, this can be prevented according to the present invention.

When the pressing device comprises an air cylinder, the damping device may comprise apertures provided in an air inflow port and an air exhaust port of the cylinder; and the vibration of the nozzle is controlled by a resisting force at a time when the air passes through the apertures. Hence, according to the present invention, the vibration of the nozzle can be controlled, since the damping force is generated in the nozzle by the resisting force according to a moving speed of the nozzle.

Preferably, the damping device controls the vibration of the nozzle by adjusting a frictional force at a time when the nozzle moves.

The pressing device may comprise a linear motor of a voice coil type. According to the present invention, it is possible to press the nozzle with a constant pressing force by letting a constant current flow to the voice coil. Further, according to the present invention, it is possible to generate a resisting force according to the moving speed of the voice coil by making a constant-current driving or a constant-voltage driving of the current of the voice coil and, therefore, the vibration of the nozzle can be controlled.

The pressing device may comprise a motor which is connected to the nozzle through a gear, the nozzle being pressed by controlling the motor. Hence, according to the present invention, it is possible to press the nozzle with a constant pressing force by letting a constant current flow to the motor. Further, it is possible to generate a resisting force according to a rotational speed of the motor by making a constant-current driving or a constant-voltage driving of the current, thereby controlling the vibration of the nozzle.

Preferably, the tape winder further comprises a tape position control device which controls a width direction position of the tape to be wound, the tape position control device being provided in an upstream side vicinity of the nozzle with respect to a winding direction of the tape. Hence, according to the present invention, the tape is not allowed to fluctuate in the width direction from a regular tape width direction at a winding approach position of the tape.

Preferably, the tape winder further comprises a control device for the tape position control device which keeps a constant distance between the tape position control device and the outer peripheral surface of the tape roll.

Preferably, the control device for the tape position control device comprises: a moving device which moves the tape position control device forward and backward with respect to the outer peripheral surface of the tape roll; a distance sensor for measuring a distance between the tape position control device and the outer peripheral surface of the tape roll; and a driving device which drives the moving device according to a measurement value outputted from the distance sensor.

Preferably, the tape position control device comprises a hollow wrap member in which the wound tape is wrapped and an interior thereof is supplied with a gas; and a wrap surface of the wrap member is formed with a number of blowout holes blowing the gas having a hole diameter of not more than 0.3 mm.

Preferably, the hole diameter of the blowout hole of the wrap member is made larger according as it goes from both ends of the wrap member along a wrap member width direction corresponding to the tape width direction to a center portion of the wrap member.

The tape position control device may comprise a crown roller.

In order to attain the above-described object, the present invention is also directed to a tape winder, comprising: a winding shaft which winds a tape to form a tape roll; a nozzle which blows a gas toward an outer peripheral surface of the tape roll at a winding time of the tape; and a tape position control device which controls a width direction position of the tape to be wound, the tape position control device being provided in an upstream side vicinity of the nozzle with respect to a winding direction of the tape.

According to the present invention, the tape position control device of the tape is provided in the upstream side vicinity of the nozzle and, therefore, the tape is not allowed to fluctuate in the width direction from the regular tape width direction position at the approach position of the tape. Here, what is meant by the regular tape width direction position is a tape width direction position for obtaining a tape roll in which the edges of the wound tape are neatly aligned and a winding form thereof is in a good condition. In this way, not only the edges of the wound tape roll are neatly aligned, but also the tape width direction position for the nozzle is stabilized and, moreover, the wind pressure driven to the tape roll from the nozzle is not biased in the tape width direction, thereby making the winding tightness uniform in the width direction of the tape. For example, in the case of a slit shaped nozzle, when a slit width (a slit length in the tape width direction) is made larger than the tape width, the gas blown out from both ends of the slit does not hit the tape and the wind pressure is apt to fluctuate and, therefore, it is customary to make the slit width and the tape width almost the same. Hence, when the tape fluctuates in the width direction in the upstream side vicinity of the nozzle, the wind pressure from the nozzle is biased in the tape width direction and, therefore, the winding tightness ends up by becoming not uniform in the width direction of the tape. Further, in the case where the bias of the wind pressure blown to the outer peripheral surface of the tape roll from the nozzle is large, since a degree of the tightness of the wound tape to the tape roll by the wind pressure changes depending on the tape width direction, there emerge portions where the caught air is let out and not let out, thereby making the winding form improper.

Preferably, the tape winder further comprises a control device for the tape position control device which keeps a constant distance between the tape position control device and the outer peripheral surface of the tape roll. According to the present invention, a tape winding approach route for the outer peripheral surface of the tape roll can be kept constant and, therefore, more stabilized winding can be performed.

Preferably, the control device for the tape position control device comprises: a moving device which moves the tape position control device forward and backward with respect to the outer peripheral surface of the tape roll; a distance sensor for measuring a distance between the tape position control device and the outer peripheral surface of the tape roll; and a driving device which drives the moving device according to a measurement value outputted from the distance sensor. According to the present invention, for example, even when the tape roll is rotating in an eccentric state, the tape position control device can be allowed to precisely follow the outer peripheral surface of the tape roll, and the distance between the outer peripheral surface of the tape roll and the tape position control device can always be kept constant. Hence, the tape winding approach position for the outer peripheral surface of the tape roll can be kept precisely constant and, therefore, more stabilized winding can be performed.

Preferably, the tape position control device comprises a hollow wrap member in which the wound tape is wrapped and an interior thereof is supplied with a gas; and a wrap surface of the wrap number is formed with a number of blowout holes blowing the gas having a hole diameter of not more than 0.3 mm. According to the present invention, the tape is supported by the wrap member non-contact and, therefore, a generation of dusting material due to a contact between the tape and the tape position control device can be prevented and, at the same time, a winding conveyance of the tape is stabilized by making the hole diameter of the blowout hole of the wrap surface not more than 0.3 mm, thereby controlling a fluctuation of the tape width direction.

Preferably, the hole diameter of the blowout hole of the wrap member is made larger according as it goes from both ends of the wrap member along a wrap member width direction corresponding to the tape width direction to a center portion of the wrap member. Hence, the tape wrapped in the wrap member is supported by the blown-out gas in a curved non-contact state and, therefore, even when the tape is supported in the non-contact state, the tape is difficult to fluctuate in the width direction. This is considered due to the fact that, because the tape is supported by the gas in a curved state and becomes the same state as if it is wrapped by the crown roller, the tape is difficult to fluctuate in the width direction.

The tape position control device may comprise a crown roller. The use of the crown roller can stabilize the traveling of the tape and does not allow the tape to fluctuate in the width direction.

Preferably, the tape winder further comprises a control device for the nozzle which keeps a constant distance between the nozzle and the outer peripheral surface of the tape roll. Hence, a constant wind pressure is always applied to the outer peripheral surface of the tape roll by the nozzle and, therefore, the tape can be wound with an adequate winding tightness.

In order to attain the above-described object, the present invention is also directed to a tape winder, comprising: a winding shaft which winds a tape to form a tape roll; a nozzle which blows a gas toward an outer peripheral surface of the tape roll at a winding time of the tape; a moving device which moves the nozzle in forward and backward directions with respect to the winding shaft; a distance sensor which measures a distance between the nozzle and the outer peripheral surface of the tape roll; and a control device which controls the moving device according to measurement values outputted from the distance sensor so that the distance between the nozzle and the outer peripheral surface of the tape roll is kept constant.

According to the present invention, the distance between the nozzle and the outer peripheral surface of the tape roll is measured by the distance sensor and, according to this measurement value, the nozzle is moved by the moving device and, therefore, the distance between the outer peripheral surface of the tape roll and the nozzle can be controlled precisely constant. Hence, for example, even when the tape roll is rotating in an eccentric state, the nozzle is allowed to rapidly follow the outer peripheral surface of the tape roll and the distance between the outer peripheral surface of the tape roll and the nozzle can always be controlled constant. In this way, a constant pressure can be applied to the outer peripheral surface of the tape roll and the tape can be wound with a uniform winding tightness. Moreover, since just the moving device of the nozzle is controlled according to the measurement value of the distance sensor, an expensive operational device and a complex control system are not required.

Preferably, the moving device comprises: a voice coil motor which moves the nozzle; and a linear motor which moves the nozzle and the voice coil motor, wherein the nozzle is moved by the voice coil motor with respect to a variable component of a high frequency from among the measurement values outputted from the distance sensor, and the nozzle is moved by the linear motor with respect to a variable component of a low frequency from among the measurement values outputted from the distance sensor.

Preferably, the tape winder further comprises a tape position control device which controls a width direction position of the tape to be wound, the tape position control device being provided in an upstream side vicinity of the nozzle with respect to a winding direction of the tape.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Preferred embodiments of a tape winder according to the present invention will be described below with reference to the attached drawings.

Figure 1:
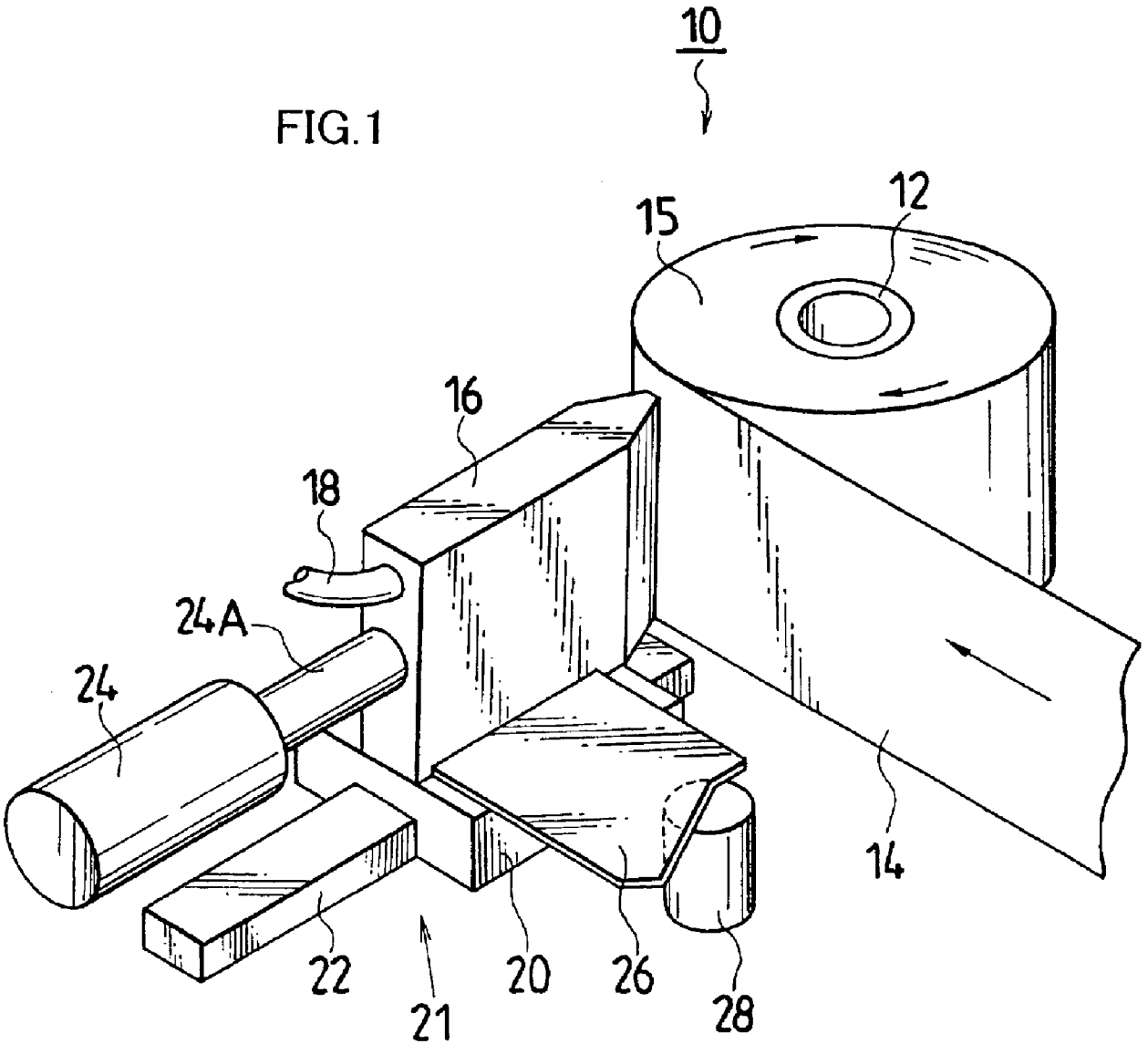
FIG. 1 is a perspective view showing a first embodiment of a tape winder according to the present invention.
Figure 2:
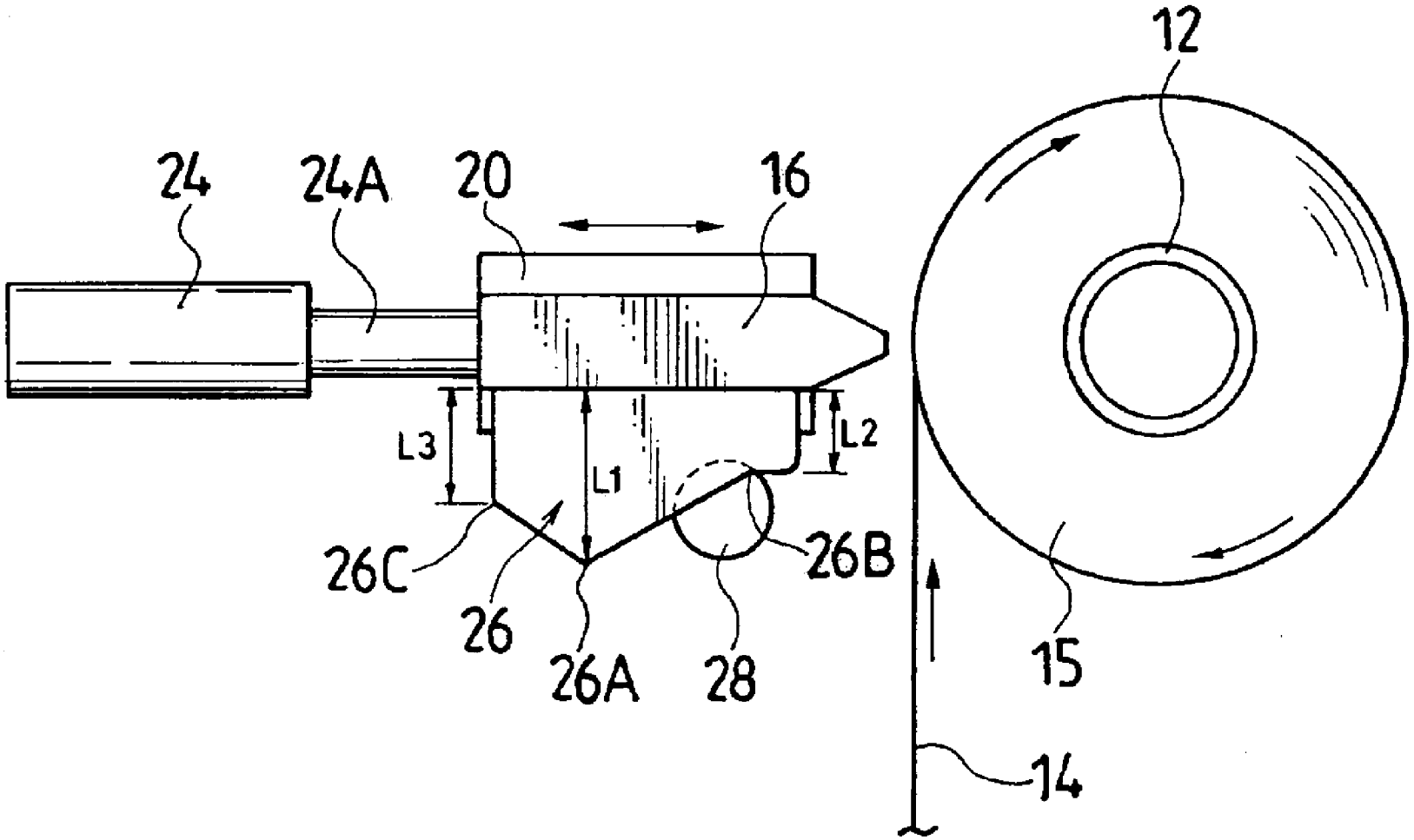
FIG. 2 is a top view showing the winder shown in FIG. 1.

FIG. 1 is a perspective view showing a first embodiment of the tape winder according to the present invention, and FIG. 2 is a top view thereof.

As shown in FIGS. 1 and 2, a winder 10 of the first embodiment has a reel (equivalent to a winding shaft) 12, and this reel 12 is rotated by the driving of a motor (not shown). In this way, a tape 14 is wound on the outer peripheral surface of the reel 12, thereby forming a tape roll 15.

A nozzle 16 is arranged in such a manner as to be opposed to the outer peripheral surface of the tape roll 15, and is connected to an air supply source (not shown) through a hose 18. The top end of the nozzle 16 is formed with a long and slit shaped opening (not shown) in the width direction of the tape 14, and a gas such as a compressed air and the like is blown out from this opening at a flow rate of, for example, 5 to 50 ($NL/mm^2 \cdot min$) toward the outer peripheral surface of the tape roll 15. The opening of the nozzle 16 is formed almost in the same width as that of the tape 14 (that is, the tape roll 15) and, by the air blown out from the opening, the outer peripheral surface of the tape roll 15 is uniformly pressed in the width direction. The size of the opening of the nozzle 16 is formed, for example, in the size of 200 mm in the width direction of the tape 14 and 0.5 mm in the traveling direction of the tape 14. Note that a blowout position of the air may be at the outer peripheral surface of the tape roll 15 and preferably slightly at the downstream side for the traveling direction of the tape 14 rather than at the position in which the tape 14 is wound to become the tape roll 15. Further, instead of the air, an inert gas such as $N_2$ and the like and gases of other types may be blown out.

The nozzle 16 is fixed on a slider 20 which constitutes a linear guide 21, and the slider 20 is slidably supported on a rail 22. The rail 22 is placed in a radial direction of the reel 12 (that is, a direction orthogonal to a surface contacting the outer peripheral surface of the tape roll 15). In this way, the nozzle 16 is supported movably forward and backward with respect to the outer peripheral surface of the tape roll 15.

The rear of the nozzle 16 is provided with an air cylinder 24. The air cylinder 24 is fixed to a building frame of a device main body (not shown). A rod 24A of the air cylinder 24 is expanded and contracted in the radial direction of the reel 12 and, by the top end of this rod 24A, the nozzle 16 is pressed toward the tape roll 15 side with a constant pressing force, for example, a pressing force of 0.49 N to 10 N (=50 gf to 1.02 kgf). When the nozzle 16 is pressed from the rear toward the tape roll 15 in this way by the pressing force of the air cylinder 24, the nozzle 16 comes closer to the tape roll 15 and automatically moves and stops at a certain position, that is, a position in which a repulsive force of an air layer formed in a space between the nozzle 16 and the tape roll 15 and the pressing force by the air cylinder 24 are balanced. Note that the air cylinder 24 is not limited to a piston type, but that a pressing device of a bellow type, which does not generate a frictional force at the moving time of the rod 24A, may be used.

For example, in the case where the distance (space) between the nozzle 16 and the outer peripheral surface of the tape roll 15 is short, a flow rate of the air flowing through the space is reduced and, therefore, a pressure of the air layer is increased and the repulsive force becomes stronger. Hence, since this repulsive force becomes stronger than the pressing force of the air cylinder 24, the nozzle 16 moves backward to a position in which both forces are balanced.

On the contrary, in the case where the distance (space) between the nozzle 16 and the outer peripheral surface of the tape roll 15 is long, since the flow rate of the air flowing through the space increases, the pressure of the air layer is reduced and the repulsive force becomes weaker.

Since this repulsive force becomes weaker than the pressing force of the air cylinder 24, the nozzle 16 moves forward by the pressing force of the air cylinder 24, and stops at a position in which both forces are balanced. In this way, since the nozzle 16 is automatically adjusted to a position in which the pressure of the air layer and the pressing force of the air cylinder 24 are balanced, the nozzle 16 is kept at a constant distance with respect to the outer peripheral surface of the tape roll 15.

The upper surface of the slider 20 is laterally provided with a conductive plate 26. Below this conductive plate 26, a magnet 28 is placed opposite to the conductive plate 26 with a slight space in-between thereof, and is fixed to the building frame of the device main body (not shown). In this way, when the slider 20 vibrates forward and backward, an eddy current is generated in the conductive plate 26 and, by this eddy current, a resisting force (damping force) is generated, and the vibration of the conductive plate 26 is damped by a magnetic resistance.

Figure 3:
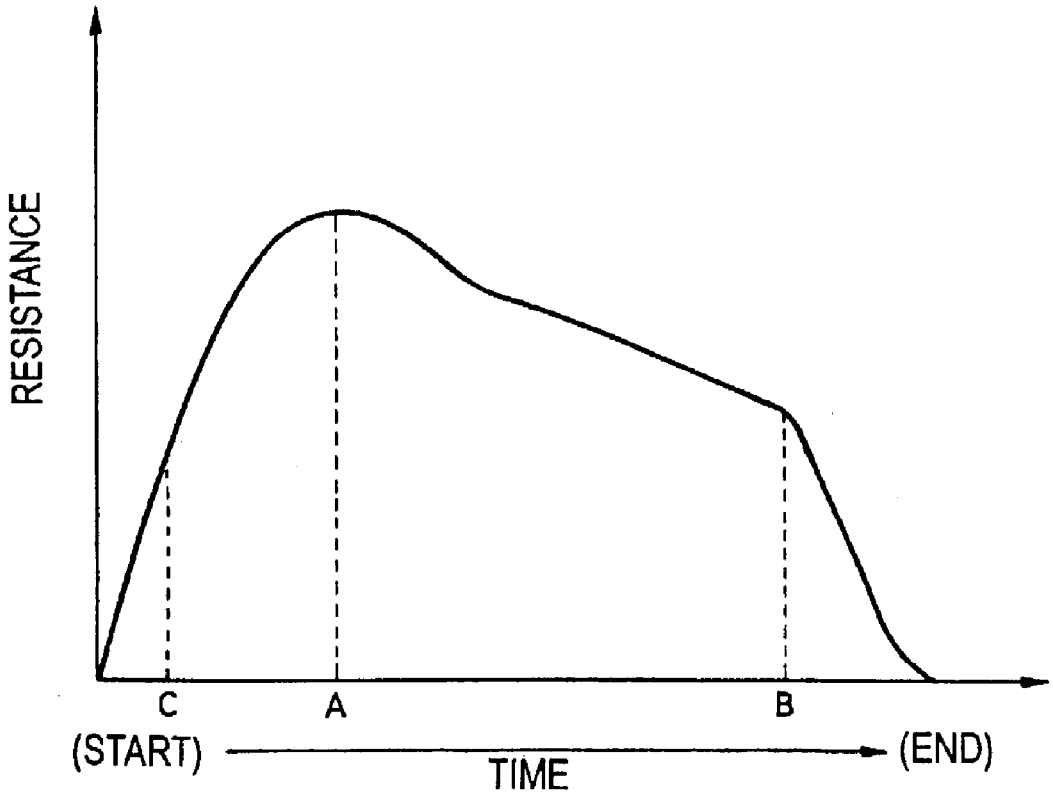
FIG. 3 is a view showing a time variation of a resisting force.

As shown by a top view in FIG. 2, a width size (a size in the vertical direction in FIG. 2) L of the conductive plate 26 is formed in such a manner that it becomes the largest width L1 at the position of 26A as shown by the drawing and gradually becomes smaller from 26A till the position of 26B as shown by the drawing so as to become a width L2 and, moreover, becomes drastically small from 26A to 26C so as to be a width L3. Hence, when the nozzle 16 is moved backward from a state in which 26C reaches the upper part of the magnet 28 to a state in which the position of 26A reaches the upper part of the magnet 28, an area in which the conductive plate 26 and the magnet 28 are opposed (hereinafter, referred to as an opposed area) is drastically increased. When the position of 26A reaches the upper part of the magnet 28, the opposed area becomes the largest and a magnetic flux which passes there becomes maximum and, when the nozzle 16 is moved backward from that state to the state in which the position of 26B reaches the upper part of the magnet 28, the opposed area is gradually reduced and the magnetic flux which passes there is also reduced. Hence, when the nozzle 16 is moved backward from a state in which it comes most close to the reel 12, a resisting force activated at the moving time of the nozzle 16 changes with the changes in the opposed area as shown in FIG. 3. That is, at first, it begins with a state having no resisting force and, according as the nozzle 16 is moved backward, the resisting force drastically increases and becomes the maximum at a point A via a point C. After going beyond the point A, the resisting force is gradually reduced with a backward movement of the nozzle 16, and after going beyond the point B, it drastically falls off and becomes zero. Note that the point A, the point B, and the point C shown in FIG. 3 correspond to a state in which reference numerals 26A, 26B, and 26C shown in FIG. 2 are positioned at the upper part of the magnet 28, respectively.

Next, the operation of the winder 10 constituted as above will be described.

The winder 10 rotates the reel 12 to wind the tape 14 on the reel 12, thereby forming the tape roll 15 and, at the same time, by blowing the air from the nozzle 16 onto the outer peripheral surface of the tape roll 15, allows the tape 14 to tightly cover the outer peripheral surface of the tape roll 15 so as to prevent the air from being caught in.

At a winding time, the nozzle 16 is pressed toward the outer peripheral surface of the tape roll 15 by a constant pressing force by the air cylinder 24. Further, there exists a relationship that the repulsive force between the tape roll 15 and the nozzle 16 is inversely proportional to the third power of the space (gap). Hence, the nozzle 16 automatically moves and stops at a position in which the repulsive force by the air layer of the top end of the nozzle 16 and the pressed force by the air cylinder 24 at the rear of the nozzle 16 are balanced. In this way, the distance between the nozzle 16 and the outer peripheral surface of the tape roll 15 is always kept constant and, therefore, a constant pressure is always applied to the outer peripheral surface of the tape roll 15 is, and the tape 14 can be wound with an adequate winding tightness. Note that the pressure applied to the outer peripheral surface of the tape roll 15 is desirably 0.05 to 0.5 MPa and the pressing force and the like are desirable to be set within this range. For example, in the case where the size of the opening of the nozzle 16 is 200 mm×0.5 mm, assuming that the pressing force of the air cylinder 24 is 10 N and a blowout flow rate of the nozzle 16 is 1000 NL/mm$^2$·min, the pressure applied to the outer peripheral surface of the tape roll 15 becomes 0.1 MPa and this is an adequate value. As the pressure becomes smaller than this value, an effect due to the blowing-out of the air gradually falls off, and when it is not more than 0.05 MPa, the effect is almost lost. Hence, the pressure is desirable to be set at not less than 0.05 MPa. Further, even when the pressure is set at larger than 0.1 MPa, a sufficient effect can be obtained depending on the material and thickness of the tape 14, but if it goes beyond 0.5 MPa, the tape 14 is in danger of being damaged. Hence, the pressure is desirable to be set at not more than 0.5 MPa. By setting the pressure within such a range, the tape 14 can be neatly wound.

According to such winder 10 of the present embodiment, the nozzle 16 is slidably supported and, at the same time, is pressed toward the tape roll 15 side by a constant pressing force and, therefore, the nozzle 16 is always kept at a constant distance from the outer peripheral surface of the tape roll 15. Further, since a constant pressure is applied to the outer peripheral surface of the tape roll 15 by the air blown out from the nozzle 16, the tape 14 is wound with an adequate winding tightness.

Further, according to the winder 10, the nozzle 16 is supported movably forward and backward with respect to the outer peripheral surface of the tape roll 15 and, therefore, when the nozzle 16 comes too close to the outer peripheral surface of the tape roll 15, the nozzle 16 moves in a direction to retreat from the outer peripheral surface of the tape roll 15 due to the increase of the repulsive force of the blown-out air layer. Hence, the nozzle 16 can be prevented from contacting the outer peripheral surface of the tape roll 15.

Now, since the nozzle 16 is balanced by the pressure of the air to be supplied, it is in danger of being vibrated or oscillated. Thus, in the tape winder 10 according to the present invention, the nozzle 16 is attached with the conductive plate 26 and, by providing the magnet 28 at a position in close vicinity of the conductive plate 26, when the nozzle 16 vibrates, the eddy current in proportion to the second power of a vibration speed is generated in the conductive plate 26 so as to give a resisting force (damping force) to the nozzle 16, thereby damping the vibration of the nozzle 16. In this way, the movement of the nozzle 16 is stabilized so that a constant pressure can be applied to the outer peripheral surface of the tape roll 15.

In particular the present embodiment, the conductive plate 26 is formed in such a manner that the resisting force acting on the nozzle 16 changes with the movement of the nozzle 16 and, therefore, the nozzle 16 can always be given an adequate resisting force. For example, at the starting time of the winding of the tape 14, as shown in FIG. 3, a small resisting force is given to the nozzle 16. In the case where the traveling speed (winding speed) of the tape 14 is not less than 10 m/sec, an increasing amount of the winding diameter of the tape roll 15 is large at the starting of the winding and, therefore, the movement in the backward direction of the nozzle 16 is also large. Hence, by making the resisting force small, the tape 14 is allowed to smoothly follow the nozzle 16 so that the nozzle can be moved.

Further, immediately before the termination of the winding also, the nozzle 16 is given a small resisting force. The winding diameter of the tape roll 15 is large immediately before the termination of the winding and, therefore, a frequency of the fluctuation of the distance between the outer peripheral surface of the tape roll 15 and the nozzle 16 with an eccentricity of the tape roll 15 is large, and the nozzle 16 is difficult to vibrate. Hence, just by giving the nozzle 16 a small resisting force, the vibration of the nozzle 16 can be sufficiently controlled.

On the other hand, in the vicinity of the points A to B shown in FIG. 3, the nozzle is given a large resisting force. In this vicinity, the nozzle 16 is apt to vibrate under the influence of the eccentricity of the tape roll 15. Hence, by giving the nozzle 16 a large resisting force, the vibration of the nozzle 16 is damped. Further, since, from the points A to B, the winding diameter of the tape roll 15 increases, the nozzle 16 becomes gradually hard to fluctuate. Thus, by making the resisting force given to the nozzle 16 gradually smaller from the points A to B, a follow-up property of the nozzle 16 for the tape roll 15 can be improved while sufficiently controlling the vibration of the nozzle 16.

In this way, in the winder 10, since the resisting force for the vibration of the nozzle 16 is automatically adjusted with the movement of the nozzle 16, the vibration of the nozzle 16 can be sufficiently controlled while maintaining the follow-up property of the nozzle 16 for the outer peripheral surface despite the winding diameter of the tape roll 15.

Note that, though the above-described embodiment uses the air cylinder 24 as a device which presses the nozzle 16 by a constant pressing force, the device is not limited to this, but other pressing device such as a hydraulic cylinder, a gravity, a magnetic force and the like may be used.

Further, though the above-described embodiment uses the nozzle 16 which is opened in a slit shape, the shape of the nozzle 16 is not limited to this, but, for example, a plurality of nozzle (not shown) in which a round hole opening is formed may be provided in the width direction of the tape 14. Further, an aperture is provided in the flow channel of the liquid which is supplied to the nozzle 16 so that a gradient (apparent spring constant) of the repulsive force between the nozzle 16 and the tape 14 may be adjusted.

Further, though the above-described embodiment provides the magnet 28 on the lower side of the conductive plate 26, the magnet 28 may be provided on the upper side or on both of the upper and tower side, and may be constituted to link with a yoke in such a manner as to close the upper and lower magnetic circuits. Further, though the above-described embodiment provides the conductive plate 26 only on the one side of the nozzle 16, the plate 26 may be provided on both sides thereof. Moreover, the conductive plate 26 may be vertically attached, and the magnet 28 may be placed on the right and left of the conductive plate 26.

Further, though the above-described embodiment attaches the conductive plate 26 to the side of the nozzle 16 and fixes the magnet 28, on the contrary, the magnet 28 may be attached to the side of the nozzle 16 and the conductive plate 26 may be fixed. Moreover, both the conductive plate 26 and the magnet 28 may be attached to the side of the nozzle 16 so as to slide with the nozzle 16.

Further, the magnet 28 may be a permanent magnet or an electromagnet. In the case where the electromagnet is used, by controlling an applied current, a magnitude of the resisting force can be adjusted according to a displacement, a speed or a frequency of the nozzle 16. In this case, the conductive plate 26 may be formed in a rectangular shape having a constant width.

Further, the conductive plate 26 may be preferable if it has conductive physical properties and, though it is not limited to a plate-like matter, it is preferable if a material being light in a specific density and good in an electroconductivity is selected.

Note that the present invention is suitable as the winder of a magnetic tape. Although the magnetic tape is required to align the edges of the tape at the winding time and also to be capable of surely preventing the air among the tape 14 from being caught in, if the winder of the present invention is used, the magnetic tape can be wound with an adequate winding tightness and, therefore, the tape can be neatly wound with the edges thereof aligned without the air being caught in.

Figure 4:
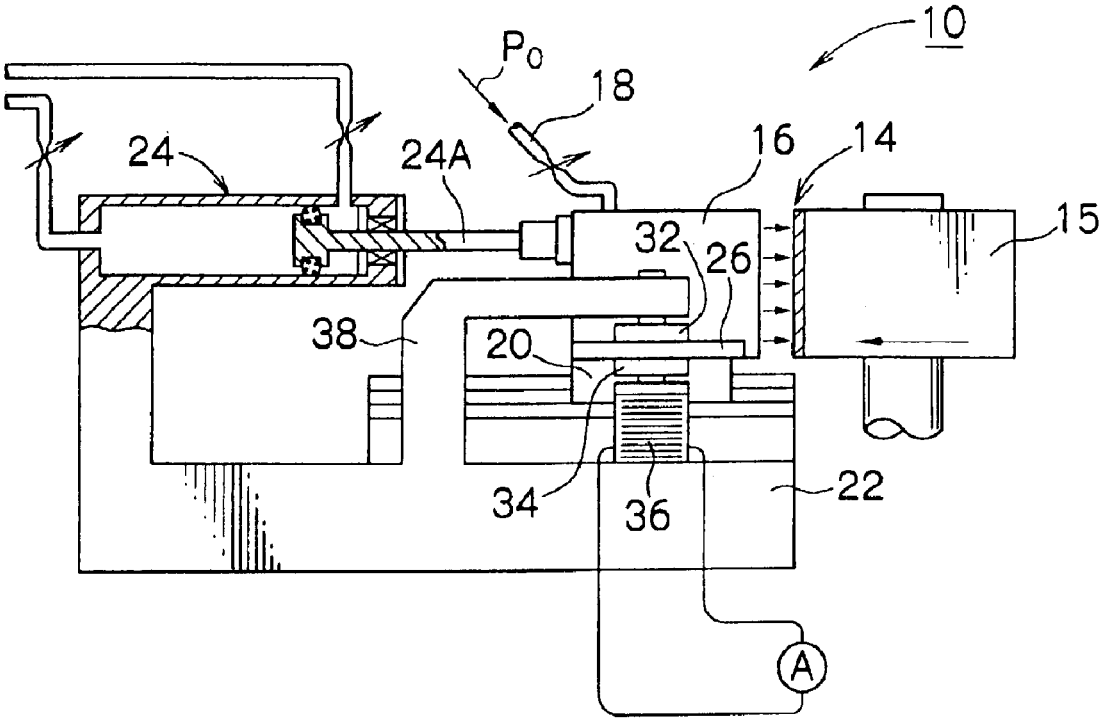
FIG. 4 is a view showing another embodiment of a mechanism which generates a damping force in a nozzle.

In FIG. 4, another embodiment of a mechanism for generating a damping force in the nozzle 16 in the tape winder 10 is shown.

In an example shown in this drawing, an inflow port and an exhaust port of the air of the air cylinder 24 provided in the winder 10 are provided with apertures for adjusting a flow rate of the liquid. Hence, when the nozzle 16 vibrates in the right and left directions in the drawing, a rod 24A also is displaced in the right and left directions. The rear end of the rod 24A is provided with a piston, and, when the rod 24A is displaced, a viscous fluid inside the air cylinder 24 is discharged from the inside of the cylinder or flows into the inside of the cylinder from the outside. At that time, the viscous fluid passes through the aperture and generates a resisting force proportional to a moving speed of the rod 24A. The resisting force generated at this time corresponding to the moving speed of the rod 24A generates a damping force in the nozzle 16 and it is, therefore, possible to control the vibration of the nozzle 16.

Note that, in the example shown in FIG. 4, though the embodiment, which is provided with the aperture for generating the damping force in the flow channel of the air cylinder 24 that applies the pressing force, was described, the present invention is not limited to the air cylinder 24, but, by providing a dashpod filled with the viscous fluid such as a fluid of other types separately from the air cylinder 24, the damping force may be given to the nozzle 16.

Further, in the example shown in FIG. 4, as another embodiment of a mechanism for generating the damping force in the tape winder 10, a brake is provided in the nozzle 16 in the tape winder 10. The brake as shown in the drawing is constituted by a conductive plate 26 (damping plate made of magnetic material), an upper side pad 32 (magnetic material) and a lower side pad 34 (magnetic material) which generate a frictional force by contacting the conductive plate 26, an electromagnet 36 which generates a force for bringing the conductive plate 26 into contact with the pad 32 and the pad 34, and a yoke 38 which is a channel of a magnetic flux for transmitting the magnetic flux generated by the electromagnet 36 to the pad 32. By adjusting the current applied to the electromagnet 36, it is possible to freely adjust the damping force (frictional force) applied to the nozzle 16.

Note that the present embodiment may be constituted in such a manner that, as a device which generates other frictional force, the piston inside the air cylinder 24 is provided with an O ring for sealing and, by adjusting the size of "squeeze" of the O ring, a constant frictional force is generated at the moving time of the nozzle 16.

Figure 5:
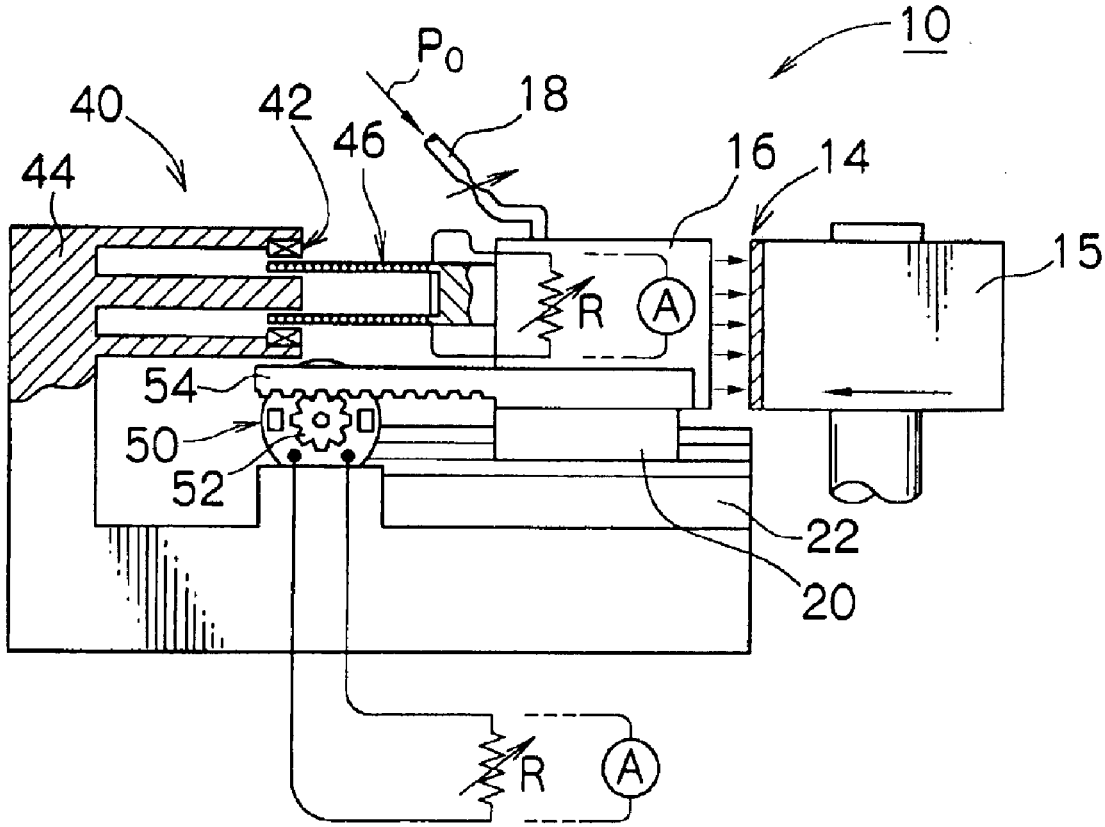
FIG. 5 is a view showing another embodiment of the mechanism which generates the damping force in the nozzle.

In FIG. 5, another embodiment of the mechanism for generating the damping force in the nozzle 16 in the tape winder 10 is shown.

In the example shown in the drawing, instead of the air cylinder 24 shown in FIG. 1, a linear motor 40 of a voice coil type is provided so that a constant pressing force is applied to the nozzle 16 in the direction of the tape roll 15. For example, a fixed side of the linear motor 40 is provided with a permanent magnet 42 and a yoke 44, and a nozzle side is provided with a voice coil 46.

By letting a constant current flow to this voice coil 46, it is possible to press the nozzle 16 in the direction of the tape roll 15 with a constant pressing force. Further, by making a constant-current driving or a constant-voltage driving of this current, it is possible to generate the resisting force corresponding to the moving speed of the voice coil 46, so that the vibration of the nozzle 16 can be damped. Further, instead of letting a constant current flow to the voice coil 46 and applying the pressing force to the nozzle 16 in the direction of the tape roll 15, a compression spring having a low spring constant is provided between the yoke 44 and the nozzle 16, so that a force may be applied in a direction to isolate the yoke 44 from the nozzle 16.

In that case, since the linear motor 40 is not required to generate the pressing force, in order to generate the damping force, a resistor may be connected between terminals of the voice coil 46 so as to damp the vibration (moving speed of the voice coil 46) of the nozzle 16. Further, by making the value of this resistance variable, it is possible to change the damping force.

Further, in the example shown in FIG. 5, a motor 50 is provided in the tape winder 10 as another embodiment of the mechanism for generating the damping force in the nozzle 16. As shown in the drawing, the motor 50 is fixed to a base of the winder 10, and a rotational shaft of the motor 50 is provided with a pinion gear 52. The other side of the nozzle 16 is provided with a rack 54, which moves with the nozzle 16, and the movement of the rack 54 allows the pinion gear 52 to rotate. Hence, the movement of the nozzle 16 is converted to a rotational amount of a rotor of the motor 50.

Even by letting a constant current flow to this motor 50, it is possible to press the nozzle 16 in the direction of the tape roll 15 with a constant pressing force. Further, by making a constant-current driving or a constant-voltage driving of this current, it is possible to generate the resisting force corresponding to the rotational speed of the motor 50, thereby controlling the vibration of the nozzle 16.

Further, instead of letting a constant current flow to the motor 50 and applying the pressing force to the nozzle 16 in the direction of the tape roll 15, by using a spring having a low spring constant, the nozzle 16 may be pressed in the direction of the tape roll 15 side. In that case, since the motor 50 is not required to generate the pressing force, in order to generate the damping force only by the motor 50, a resistor may be connected between terminals of the motor 50 so as to damp the vibration (rotational speed of a rotor of the motor 50) of the nozzle 16. Further, by making the value of this resistance variable, it is possible to change the damping force.

Figure 6:
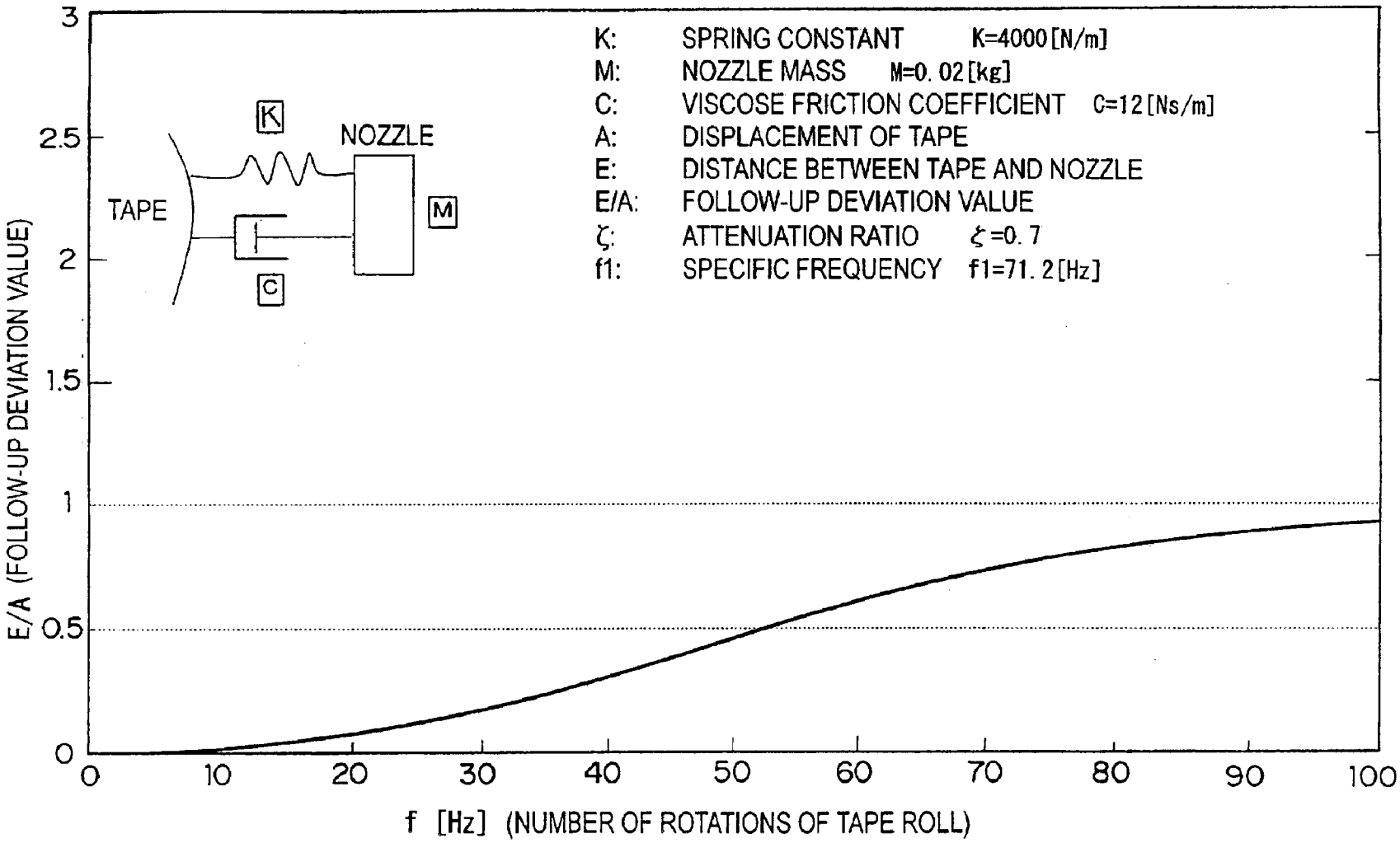
FIG. 6 is a calculation example of a frequency characteristic of a follow-up deviation value by a mechanism which generates the damping force in the nozzle.

In FIG. 6, a calculation example of the frequency characteristic of a follow-up deviation value of the nozzle 16 in the case where the mechanism for generating the damping force in the nozzle 16 in the tape winder 10 is provided is shown.

In the drawing, the frequency characteristic of the follow-up deviation value of the tape 14 and the nozzle 16 is shown in a model where a spring constant K between the nozzle 16 and the tape 14 is 4000 N/m, a mass M of the nozzle 16 is 0.02 kg, and a viscose friction coefficient (or damping coefficient) C between the nozzle 16 and the tape 14 is 12 Ns/m.

When the constants are set as shown in the drawing, since it is equivalent to the case where an attenuation ratio $$\zeta = \frac{C}{2\sqrt{M \cdot K}} = 0.7$$

and a characteristic frequency is f1=71.2 Hz, in the case where the distance between the tape 14 and the nozzle 16 can be set relatively long to the extent of several mm, it is possible to secure the follow-up property till the frequency to the extent of about 80 Hz (equivalent to the case where the outer shape of the tape roll is 40 mm and the winding speed of the tape 14 is 10 m/s). Further, even in the case where the distance between the tape 14 and the nozzle 16 is about 1 mm and the displacement of the tape 14 is about 0.5 mm, it can be coped with by the constant shown in the drawing. Further, even in the case where the distance between the tape 14 and the nozzle 16 is about 1 mm and the displacement of the tape 14 is about 1 mm, if the frequency (the number of rotations of the tape roll 15) is not more than 40 Hz, it can be coped with by the constant shown in the drawing.

Note that in the case where the width of the tape 14 is wide and the mass of the nozzle 16 is heavy such as 1 kg or in the case where other conditions are changed, the spring constant K and the viscose friction coefficient C are decided according to the number of windings of the tape roll 15 to be used and the displacement of the tape 14.

Figure 7:
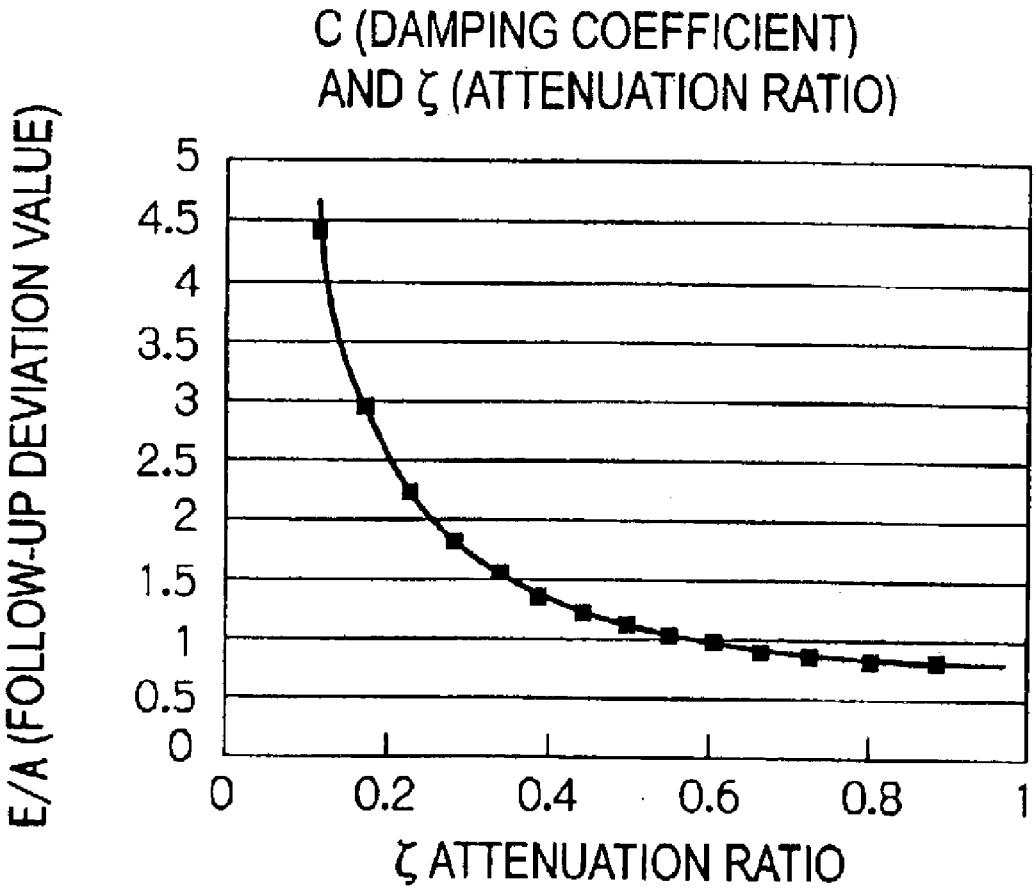
FIG. 7 is a view showing a relationship between an attenuation ratio and the follow-up deviation value of the mechanism which generates the damping force in the nozzle.

In FIG. 7, a relationship between the attenuation ratio ζ of the mechanism for generating the damping force provided in the tape winder 10 and the follow-up deviation value is shown.

As shown in the drawing, the maximum value of the follow-up deviation value (E/A) changes on a large scale depending on the value of the attenuation ratio ζ. When the value of the attenuation ratio ζ is small, the vibration due to a resonance increases and the follow-up deviation value is deteriorated. Hence, in a damping device of the tape winder 10 according to the present invention, since the space between the tape 14 and the nozzle 16 is narrow, it is desirable to set various constants in such a manner as to be $\zeta \geqq 0.7$.

Next, a second embodiment of the winder according to the present invention will be described.

Figure 8:
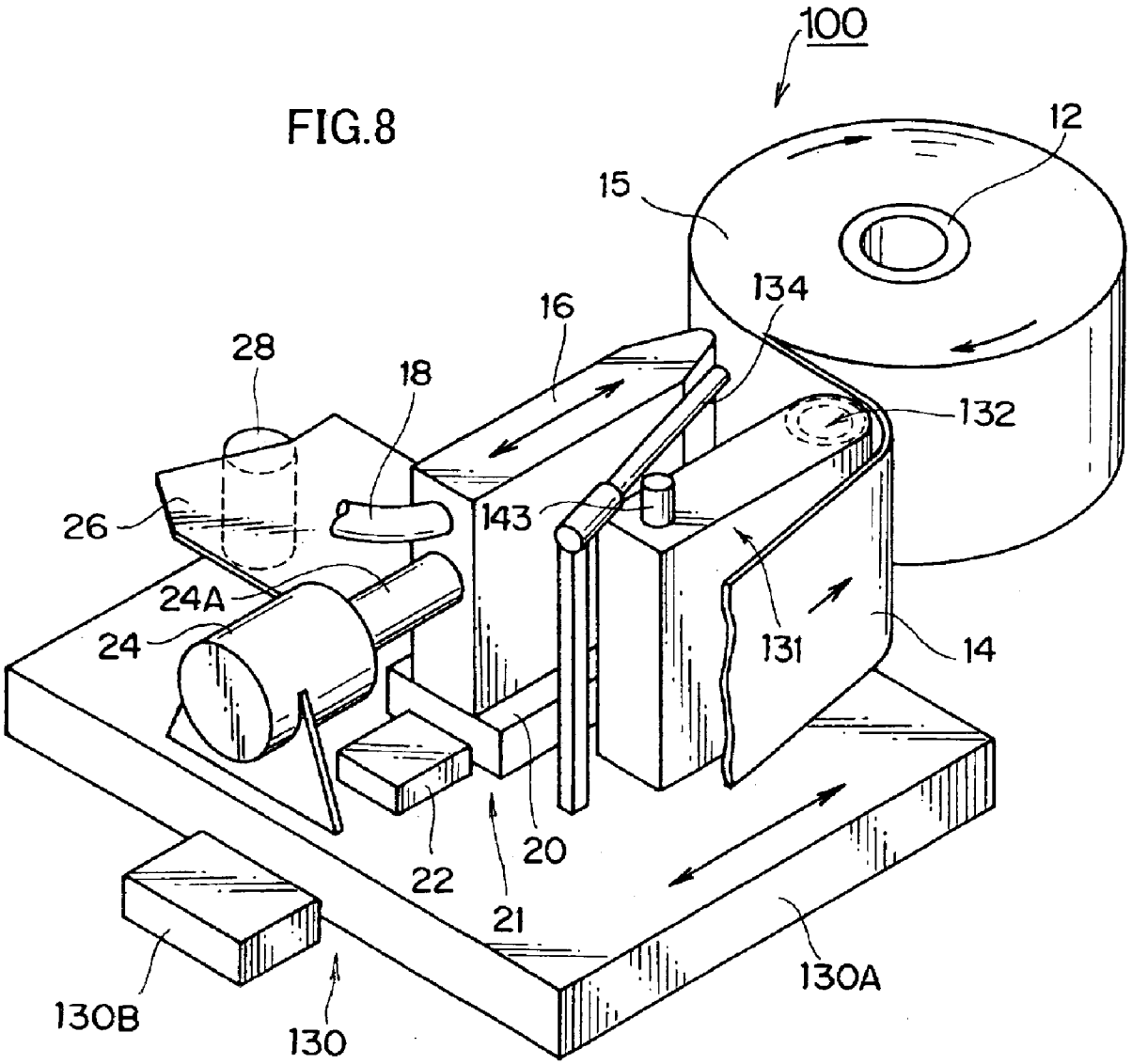
FIG. 8 is a perspective view showing a second embodiment of the tape winder according to the present invention.
Figure 9:
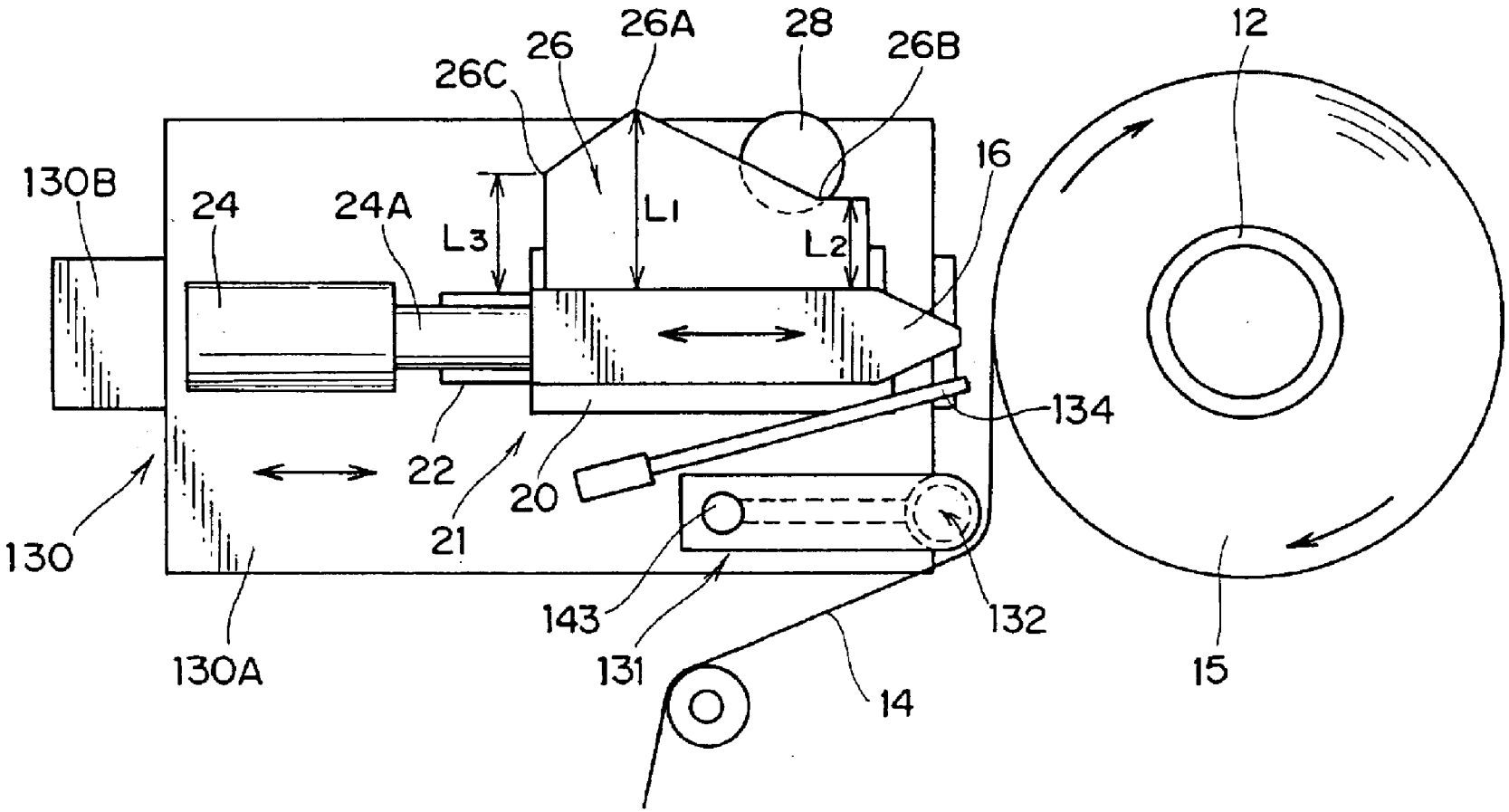
FIG. 9 is a top view showing the winder shown in FIG. 1 from above.

FIG. 8 is a perspective view showing a winder 100 of a second embodiment and FIG. 9 is a top view of the same. Note that, in these drawings, the components having almost the same functions, constitutions as those of the winder 10 of the first embodiment will be designated by the same reference numerals and the description thereof will be omitted.

An opening formed at the top end of a nozzle 16 is formed almost by the same width as that of a tape 14 (that is, a tape roll 15), and it is important that, by the air blown out from the opening, an outer peripheral surface of the tape roll 15 is pressed uniformly in a width direction. However, the opening of a nozzle 16 is not limited to almost the same width as the tape width.

The rear of the nozzle 16 is provided with an air cylinder 24 and, by the top end of a rod 24A of the air cylinder 24, the nozzle 16 is pressed toward the tape roll 15 side by a constant pressing force, for example, about 0.98 N (=100 gf).

The air cylinder 24 and the rail 22 of the linear guide 21 are mounted on a linear motor 130. That is, the air cylinder 24 and the rail 22 are fixed on a movable body 130A comprising a permanent magnet and a yoke and, at the same time, the movable body 130A is supported by a long fixed body 130B comprising an exciting coil and a yoke arranged in a radial direction of the reel 12. As the linear motor 130, a compact linear motor available in the market can be used suitably.

On the movable body 130A of the linear motor 130, there are provided a tape position control device 131 and a distance sensor 134.

Figure 10A:
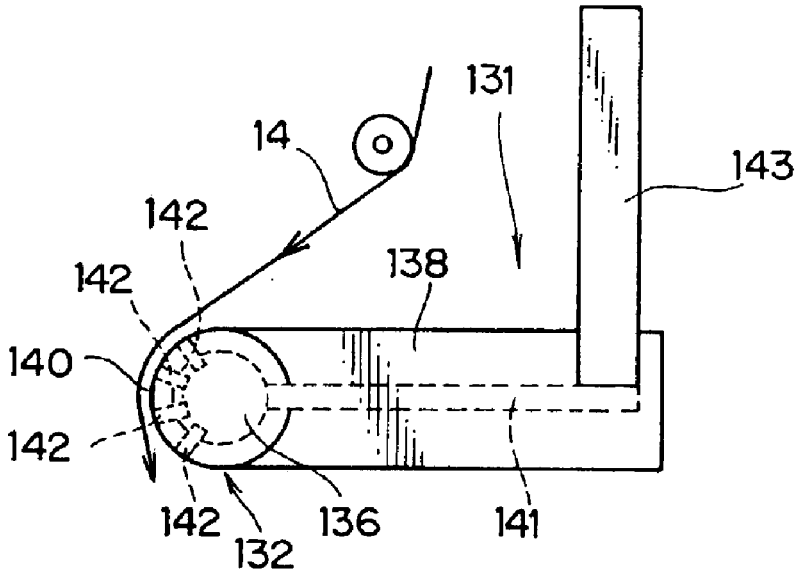
FIGS. 10(A) and 10(B) are conceptual illustrations to explain an example of a width direction position control device.
Figure 10B:
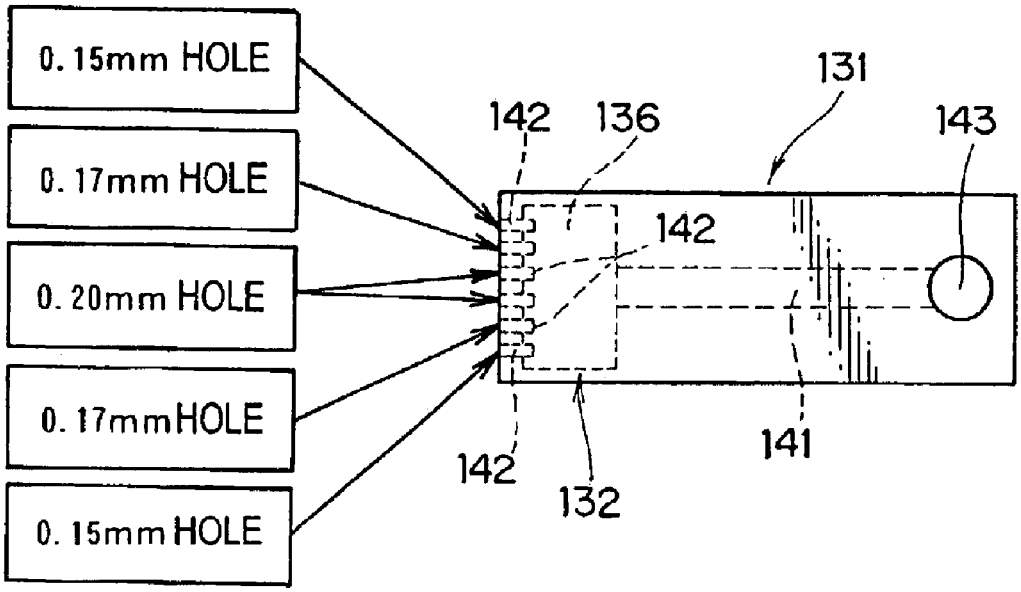

The tape position control device 131, as shown in FIGS. 8, 10(A) and 10(B), comprises a long hollow cylindrical wrap member 132 in the width direction of the tape 14, and a compressed air is supplied to the hollow inside of the wrap member 132 from an air supply source (not shown) through an air duct 143 and an air channel 141 formed inside the support member 138 which supports one side of the peripheral surface of the wrap member 132. Instead of the air, an inert gas such as $N_2$ and the like and gases of other types may be supplied. A wrap surface 140 of the wrap member 132 in which the tape 14 to be wound is wrapped is formed with a number of blowout holes 142, and the compressed air supplied to the inside portion 136 of the wrap member 132 is blown out from the blowout holes 142. In this way, the tape 14 which is wound while being wrapped on the wrap surface 140 of the wrap member 132 is put into a state of being supported by the wrap surface 140 in a non-contact state and is subjected to a position control in the tape width direction. In this case, by making a hole diameter of the blowout hole 142 formed on the wrap surface 140 not more than 0.3 mm, a winding conveyance of the tape 14 which is supported in a non-contact state can be stabilized, thereby making it possible to control a fluctuation of the width direction of the tape 14. More preferably, as shown in FIG. 10(B), the hole diameter of the blowout hole 142 of the wrap member 132 may be made larger according as it goes from both ends of the wrap member width direction corresponding to the tape width direction to a center portion. As the change in the size of the hole diameter, it is desirable that the center portion of the wrap member 132 is within the range of not more than 0.30 mm to not less than 0.20 mm, both ends of the center portion is below 0.20 mm to not less than 0.17 mm, and each end portion is below 0.17 mm to not less than 0.15 mm. Note that FIG. 10(B) shows an example in which the center portion is 0.20 mm, both ends of the center portion is 0.17 mm and each end portion is 0.15 mm. In this way, since the tape 14 wrapped by the warp member 132 is supported by the blown-out air in a curved non-contact state, even if the tape 14 is supported in a non-contact state, the tape 14 is difficult to fluctuate in the width direction. In this way, the tape 14 is subjected to the position control in the tape width direction in a non-contact state with the tape position control device 131 and, therefore, a generation of a dusting material such as a contact dust which would generate if the tape 14 contacted the tape position control device 131 can be prevented. The above-described tape position control device 131 such as the wrap member 132 can be fabricated by modifying a flangeless air bearing. That is, an air bearing shaft is fixed, and a blowout hole 142 is formed on one side of the peripheral surface in which the tape 14 is wrapped from among a bearing casing peripheral surface, and the compressed air supplied from a gas supply port of the air bearing is allowed to blow out from the blowout hole 142. As a material of the wrap member 132, it is desirable to use SUS303, SUS304, ceramics and the like.

The distance sensor 134 is a sensor, which keeps a constant distance between the tape position control device 131 and the outer peripheral surface of the tape roll 15 according as a diameter of the tape roll 15 increases as the winding of the tape 14 advances. As the distance sensor 134, a reflective type optical sensor using, for example, laser beams can be used suitably. The reflective type optical sensor projects a light onto the outer peripheral surface of the tape roll by a light projecting element (not shown) and the reflected light is received by a light receiving element (not shown), so that the distance between the distance sensor 134 and the outer peripheral surface of the tape roll 15 is measured in a non-contact state. The measurement result is inputted to the linear motor 130, and the linear motor 130 moves the movable body 130A so that the distance between the distance sensor 134 and the outer peripheral surface of the tape roll 15 is kept constant. In this way, the distance between the tape position control device 131 which is fixed on the same movable body 130A as with the distance sensor 134 and the outer peripheral surface of the tape roll 15 is also kept constant. Note that the distance sensor 134 is not limited to the reflective type optical sensor using laser beams, but any sensor may be used if it can precisely measure the distance to the outer peripheral surface of the tape roll 15.

According to the winder 100 constituted as described above, the tape 14 to be wound on the reel 12 is controlled in a position of the width direction of the tape 14 by the tape position control device 131 so as to be positioned at a regular tape width position in the upstream side vicinity of the nozzle 16 with respect to the winding direction of the tape 14. The tape 14 controlled in the position of the tape width direction is wound while the compressed air from the nozzle 16 is blown to the outer peripheral surface of the tape roll 15 at the winding time.

In such a winding operation of the tape, in a tape winding approach position immediately before the tape 14 is wound, the fluctuation of the width direction of the tape 14 is prevented by the tape position control device 131, so that a winding conveyance of the tape 14 is stabilized and the edges of the wound tape roll 15 can be neatly aligned. Moreover, the tape position control device 131 moves the movable body 130A of the linear motor 130 according to the measurement result of the distance sensor 134, so that the distance between the tape position control device 131 and the outer peripheral surface of the tape roll 15 is always kept constant. In this way, the approach route of the tape 14 for the outer peripheral surface of the tape roll 115 is always kept constant and, therefore, the winding conveyance of the tape 14 can be stabilized all the more. In this case, it is much preferable that the tape position control device 131 uses a member such as the wrap member 132 which can support the tape in a non-contact state. In this way, the tape 14 and the tape position control device 131 are not brought into contact with each other, so that no dusting material such as tape whittlings and the like due to a contact is generated. Hence, the dusting material is not wound into the space between the tape 14 and the tape roll 15 with the winding of the tape 14 and, therefore, the dusting material will not adhere to a tape surface or the tape surface is not damaged by the dusting material.

Further, since the nozzle 16 is automatically adjusted to a position in which the pressure of an air layer by a gas blown out from the nozzle 16 and a pressing force of the air cylinder 24 are balanced, the nozzle 16 is always kept at a constant distance to the outer peripheral surface of the tape roll 15. In this case, the conductive plate 26 is formed in such a manner that a resisting force acting on the nozzle 16 changes with the movement of the nozzle 16 and, therefore, an adequate resisting force can always be given to the nozzle 16. Hence, the air pressure blown to the outer peripheral surface of the tape roll 15 from the nozzle 16 is constant and, therefore, the winding tightness of the tape can always be kept at an adequate tightness by setting the air pressure adequately. In such blowing-out of the air to the outer peripheral surface of the tape roll 15 by the nozzle 16, the width direction position of the tape 14 is controlled by the tape position control device 131 and, at the same time, the approach route of the tape 14 for the outer peripheral surface of the tape roll 15 is kept constant and, therefore, the air pressure blown out from the nozzle 16 can be uniformly blown out without deviating in the width direction of the tape 14. In this way, not only the winding tightness of the tape 14 is set adequately, but also the winding tightness in the width direction of the tape 14 can be made uniform.

In this way, since the winder 100 of the present invention can neatly align the edges of the wound tape 14 and, at the same time, can make the winding tightness uniform in the width direction of the tape 14, the tape roll having a good winding shape and no winding collapse can be formed.

Figure 11:
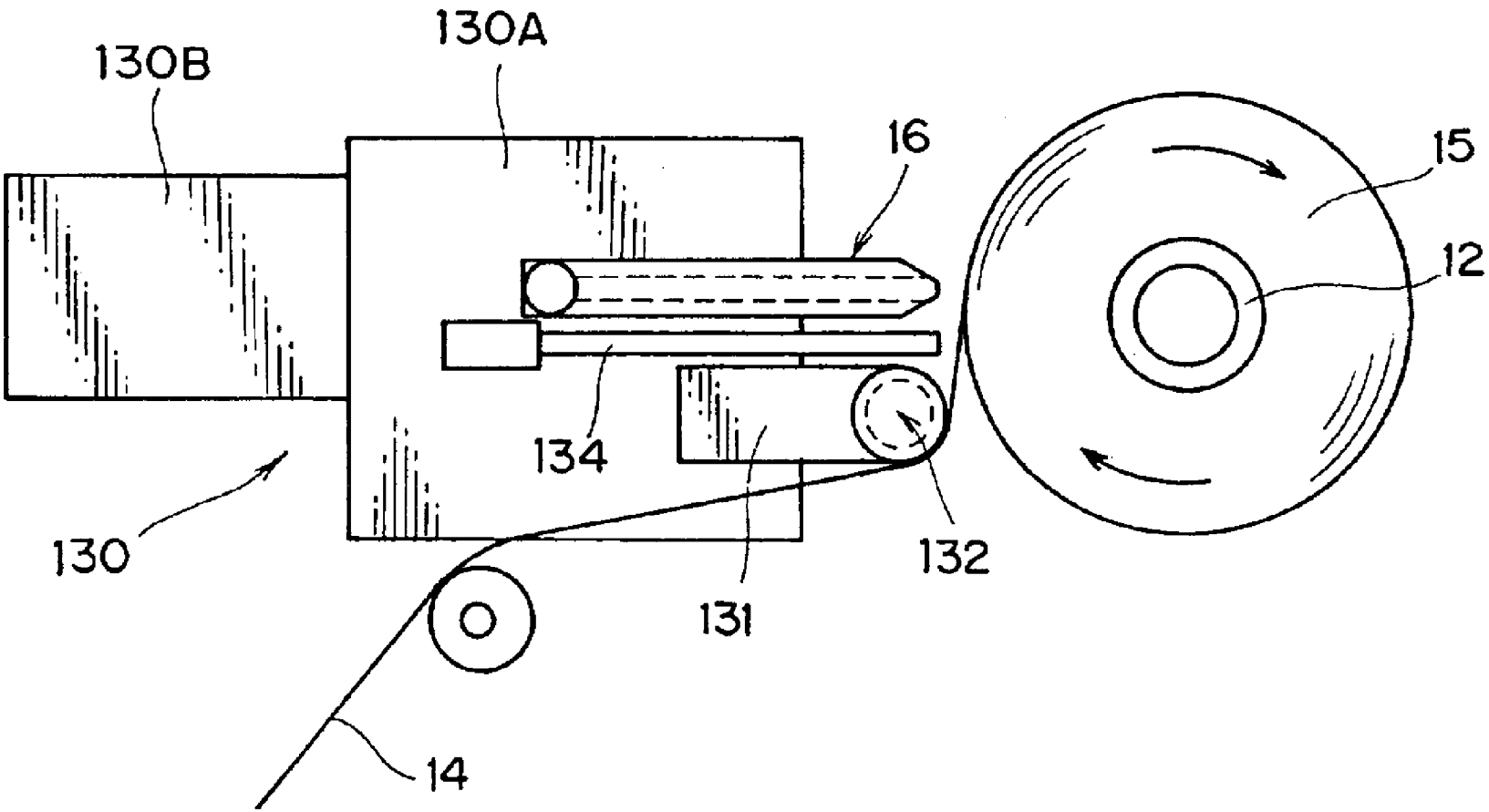
FIG. 11 is an explanatory drawing to explain another mode of the winder of the present invention.

FIG. 11 shows another mode of the winder 100 of the present invention, where the nozzle 16, the tape position control device 131 and the distance sensor 134 are all mounted on the movable body 130A of the linear motor 130. In this case, according to the measurement result between the distance sensor 134 and the outer peripheral surface of the tape roll 15 to be measured by the distance sensor 134, the distance between the nozzle 16 and the outer peripheral surface of the tape roll 15 and the distance between the tape position control device 131 and the outer peripheral surface of the tape roll 15 are controlled so as to be constant.

Figure 12:
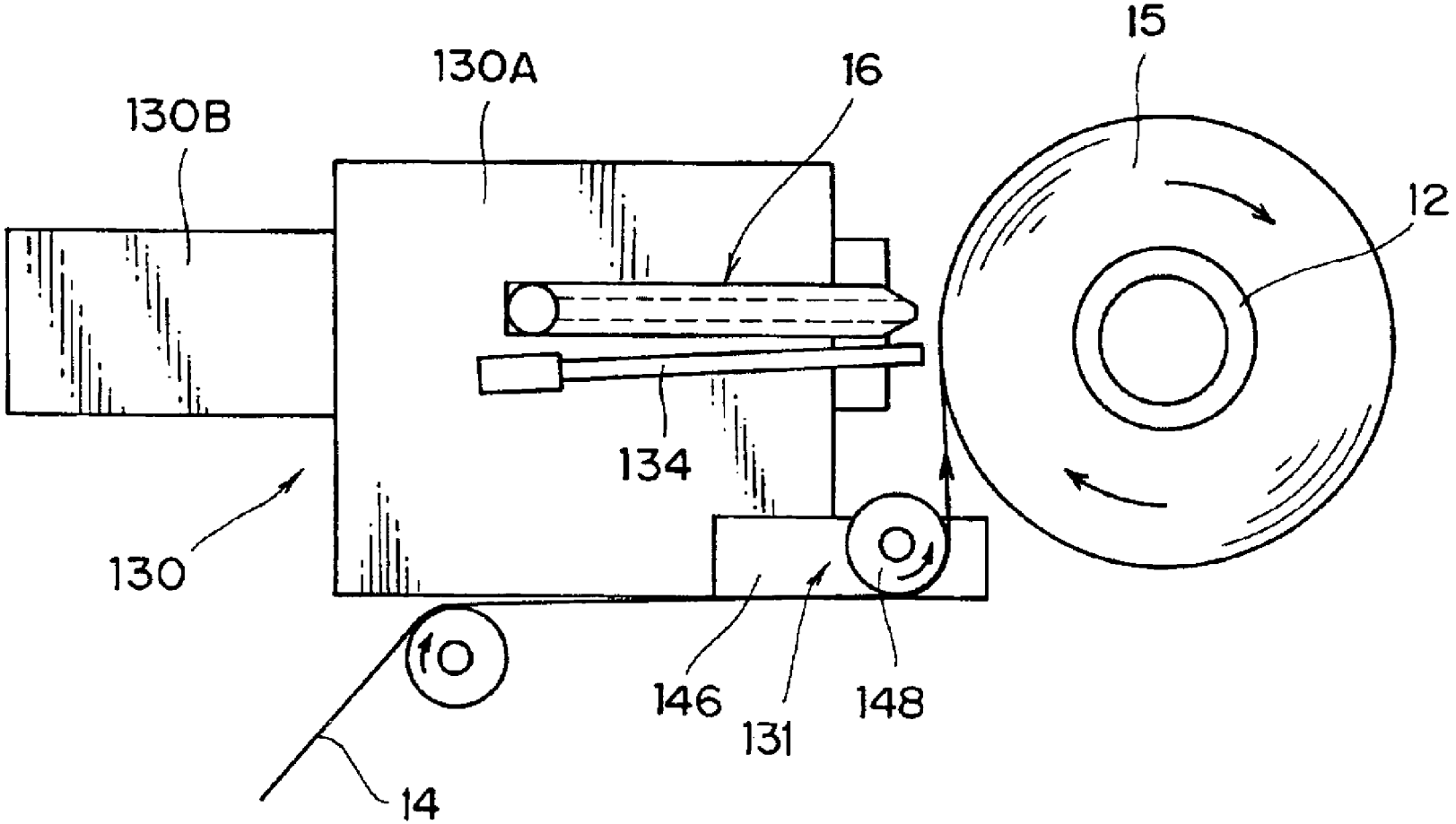
FIG. 12 is an explanatory drawing to explain another mode of the winder of the present invention in which a pass roller attached with a flange is used as a width direction position control device.

FIG. 12 shows another mode of the winder 100 of the present invention, where the tape position control device 131 is constituted by a pass roller 148 with a flange 146. In this case, one side of the width direction of the tape 14 which is wound and conveyed while being engaged with the pass roller 148 is guided by the flange 146. In this way, the position of the tape 14 in the width direction is controlled and the edges of the wound tape 14 can be neatly aligned. At the same time, the winding tightness can be made uniform in the width direction of the tape roll 15.

Figure 13:
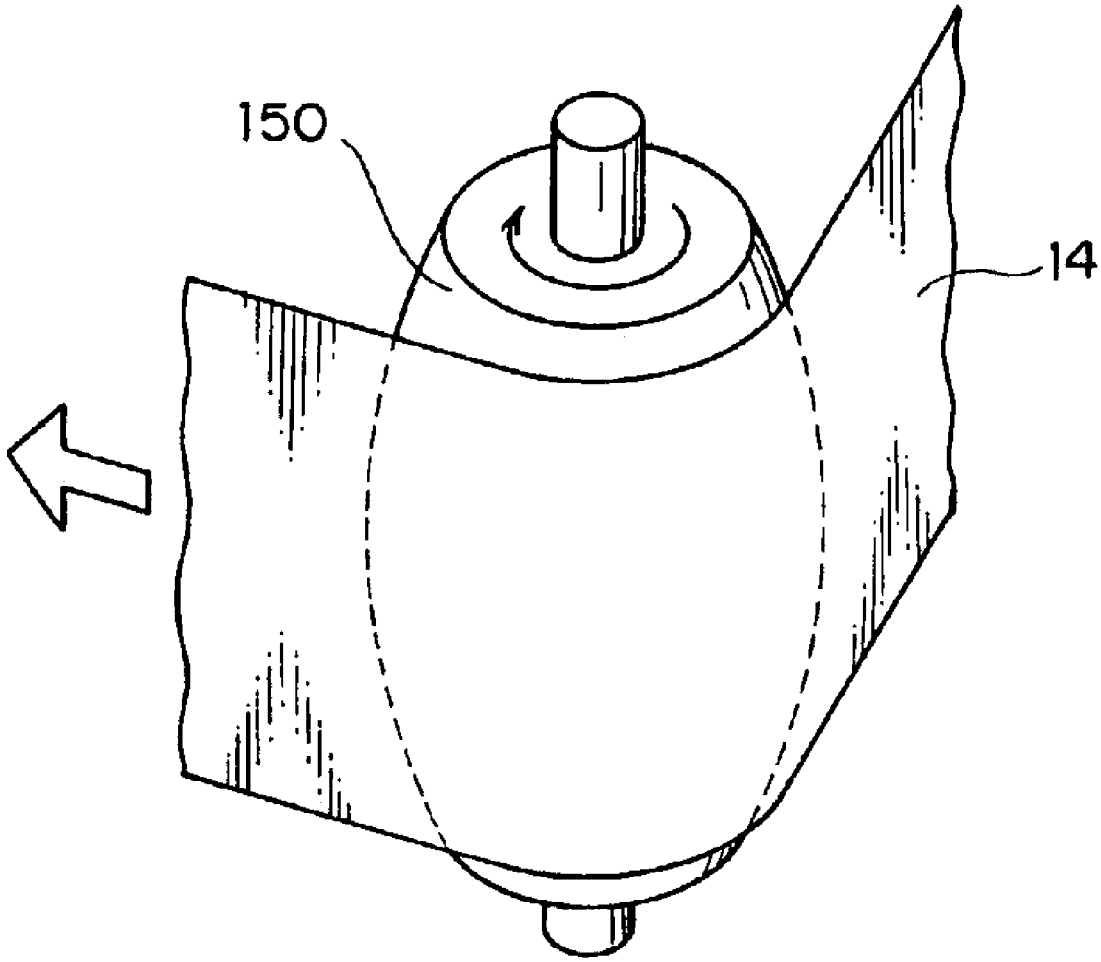
FIG. 13 is an explanatory drawing to explain a crown roller as other example of the width direction position control device.

FIG. 13 shows the case where a crown roller 150 is used as the tape position control device 131, and by using the crown roller 150, the position control can be made so that the tape 14 to be wound does not fluctuate in the width direction. In this way, the edges of the wound tape 14 can be neatly aligned and, at the same time, the winding tightness can be made uniform in the width direction of the tape 14. Note that, in the case of using the crown roller 150, the flange 146 provided in the pass roller 148 shown in FIG. 12 is not required.

Figure 14:
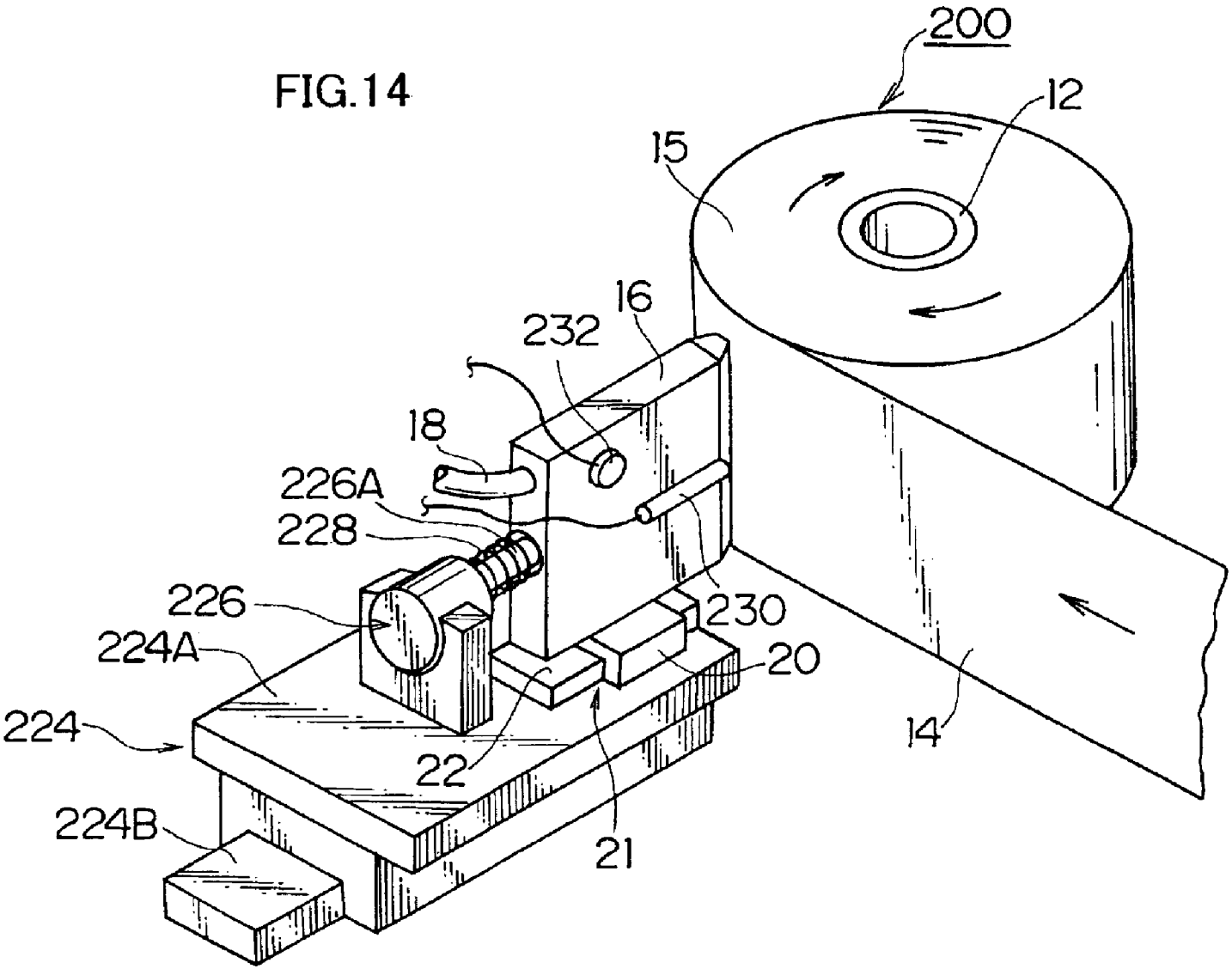
FIG. 14 is a perspective view showing a third embodiment of the tape winder according to the present invention.

FIG. 14 is a perspective view showing a tape winder 200 of a third embodiment. In the drawing, the members having the same functions, constitutions as those of the winder 10 of the first embodiment are designated by the same reference numerals and the description thereof will be omitted.

A rail 22 of the linear guide 21 is fixed on a frame 224A of a linear motor 224. In this way, a nozzle 16 is supported movably forward and backward with respect to an outer peripheral surface of a tape roll 15.

A voice coil motor 226 of a linear type is placed on the upper surface of the frame 224A. The voice coil motor 226 is placed at the rear of the nozzle 16 (that is, opposite side to a tape roll 15) and comprises a rod 226A which presses the nozzle 16 in the forward direction. By pushing and pulling this rod 226A, the nozzle 16 is moved in the forward and backward directions with respect to the outer peripheral surface of the tape roll 15. By using the voice coil motor 226 thus constituted, though the movement of the nozzle 16 is not much large, the nozzle 16 can be precisely and rapidly moved. Hence, it is convenient to use the voice coil motor 226 when the nozzle 16 is moved at high frequency.

Note that, as shown in FIG. 14, a spring 228 may be placed outside of the rod 226A. By providing this spring 228, a force to press the nozzle 16 in the forward direction is supplemented. Further, instead of using the spring 228, a constant current may be applied to the voice coil motor 226 so as to press the nozzle 16 in the forward direction.

The frame 224A is slidably supported along a guide 224B, and the guide 224B is placed in the radial direction of the reel 12 and is fixed to a building frame (not shown) of the winder 200. The inside of the frame 224A is provided with a driving portion (not shown) so that the frame 224A can be moved along the guide 224B. In this way, the nozzle 16 can be moved in the forward and backward directions with respect to the outer peripheral surface of the tape roll 15. Note that the linear motor 224 can move the nozzle 16 on a large scale. Hence, the motor is used when the nozzle 16 is moved on a large scale at a low frequency.

The nozzle 16 is attached with a displacement gage 230. The displacement gage 230 is a sensor to measure the distance between the nozzle 16 and the outer peripheral surface of the tape roll 15 and, for example, a reflective type optical sensor is used. The reflective type optical sensor projects a light to the outer peripheral surface of the tape roll 15 by a light projecting element (not shown), and the reflected light is received by a light receiving element (not shown), so that the distance between the nozzle 16 and the outer peripheral surface of the tape roll 15 is measured in a non-contact state. The linear motor 224 and the voice coil motor 226 are controlled so as to keep the measurement value constant.

The displacement gage 230 may be a fiber or a reflective type sensor or a reflective type sensor which measures reflected light amount as a distance, or with triangulation.

Note that, as the displacement gage 230, a transmission optical sensor may be used, which is constituted in such a manner that the light transmitted from upward to downward through a space between the nozzle 16 and the tape roll 15 is received by a light receiving sensor provided under the nozzle 16 and the tape roll 15.

Further, since an air pressure on the nozzle surface and a flow rate of the air blown out from the nozzle 16 change according to the change in the space between the nozzle 16 and the tape roll 15, the flow rate and the pressure of the air blown out from the nozzle 16 are measured by using an AE sensor or a pressure sensor, and an operational processing to convert the measurement value to the distance of the space between the nozzle 16 and the tape roll 15 may be performed.

Further, the nozzle 16 is attached with a contact sensor 232. The contact sensor 232 is a sensor, which detects the nozzle 16 being brought into contact with the tape roll 15 and, for example, a piezo vibration meter, the displacement gage and the like are used. Moreover, in the case where the pressing force to press the nozzle 16 in the direction of the tape roll 15 is measured by a load sensor and the like and this pressing force is measured to be larger than a predetermined value, the nozzle 16 and the tape roll 15 may be determined to be brought into contact with each other. In addition to measuring the pressing force, a potential change with the tape roll and the like may be detected.

Further, in the case where the flow rate and the pressure of the air blown out from the nozzle 16 are measured by an AE sensor or a pressure sensor, and the measurement value thereof does not exceed a predetermined flow rate or exceeds a predetermined pressure, it may be determined that the nozzle 16 and the tape roll 15 are brought into contact with each other.

By using the contact sensor 232 and the like as described above, the fact that the nozzle 16 was brought into contact with the tape roll 15 can be detected.

Figure 15:
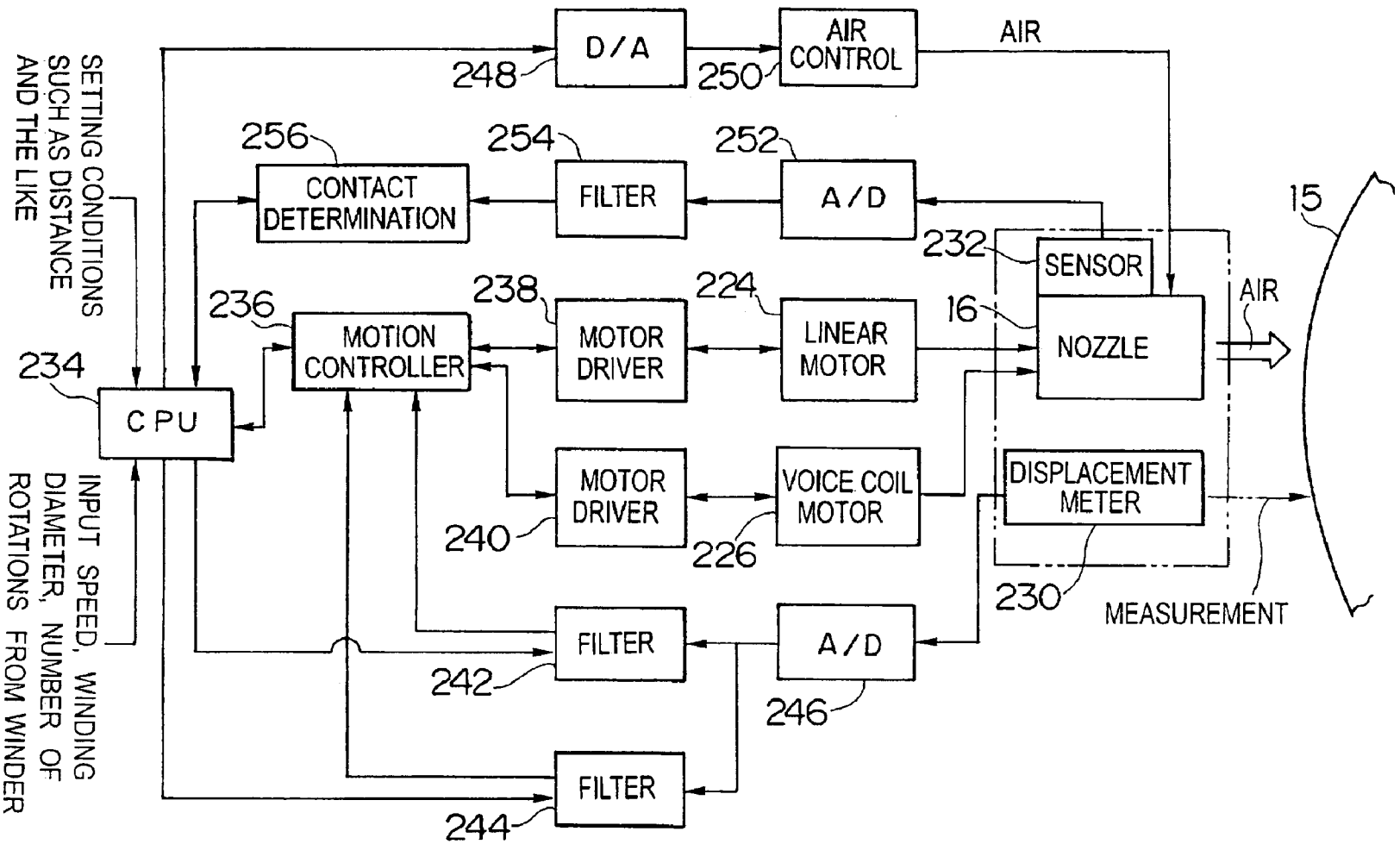
FIG. 15 is a block diagram showing a constitution of the winder shown in FIG. 14.

FIG. 15 is a block diagram showing a constitution of the winder 200.

As shown in the drawing, a CPU 234 of the winder 200 is connected to a motion controller 236. The motion controller 236 is connected to the linear motor 224 through a motor driver 238, and is also connected to the voice coil motor 226 through a motor driver 240, and controls the drive of the linear motor 224 and the voice coil motor 226.

Further, the motion controller 236 is connected to filters 242, 244, and these filters 242, 244 are connected to the displacement gage 230 through an A/D converter 246. A distance data measured by the displacement gage 230 is A/D converted by the A/D converter 246 and, after that, is subjected to the filters 242, 244. The filter 242 is a bypass filter, which allows a signal only of the frequency above the cutoff frequency to pass through and attenuates a signal of the frequency below the cutoff frequency. According to the data that passes through the filter 242, the motion controller 236 drives the voice coil motor 226 to move the nozzle 16.

On the other hand, the filter 244 is a low pass filter, which allows a signal only of the frequency below the cutoff frequency to pass through and attenuates a signal of the frequency above the cutoff frequency. According to the data that passes through the filter 244, the motion controller 236 drives the linear motor 224 to move the nozzle 16.

In this way, for a variable component of a high frequency from among the data measured by the displacement gage 230, the movement of the nozzle 16 is performed by the voice coil motor 226 having a good high frequency response and, for a variable component of a low frequency, the movement of the nozzle 16 is performed by the linear motor 224 having a wide movable range, so that the distance between the nozzle 16 and the tape roll 15 is controlled constant. Note that the filters 242, 244 are connected to the CPU 234 and, by this CPU 234, the setting of the cutoff frequency is performed.

The CPU 234 is connected to an air control unit 250 through a D/A converter 248. The air control unit 250 is a device, which adjusts a flow rate and a pressure of the air supplied to the nozzle 16, and the flow rate and the pressure of the air are set according to a command outputted by the CPU 234. Note that, when a traveling speed of the tape 14 and the number of rotations of the reel 12 are inputted to the CPU 234, the CPU 234 arithmetically operates a winding diameter of the tape roll 15 from these values and, according to a result of the arithmetical operation, the flow rate and the pressure of the air to be supplied to the nozzle 16, and the cutoff frequencies of the filters 242, 244 are set.

The contact sensor 232 is connected to a contact determination circuit 256 through an A/D converter 252, a filter 254. Hence, the measurement data such as a vibration, a position change, an air flow rate, an air pressure of the nozzle 16 measured by the contact sensor 232 and the like are A/D converted by the A/D converter 252 and subjected to the filter 254. The contact determination circuit 256 determines whether or not the nozzle 16 contacts the tape roll 15 according to the data that passes through the filter 254.

When determined that the contact was made, the CPU 234 issues a command to the motion controller 236, and allows the linear motor 224 and the voice coil motor 226 to be driven so as to retreat the nozzle 16. Note that a position of the tape 14 at which the nozzle 16 contacts is recorded in the CPU 234 as a NG portion of the product, which may be removed in a subsequent step. Alternatively, the rotation of the winding reel 12 may be stopped simultaneously with a contact determination.

Next, the operation of the winder 200 constituted as above will be described.

The winder 200 rotates the reel 12 to wind the tape 14 on the reel 12 to form the tape roll 15 and, at the same time, blows the air to the outer peripheral surface of the tape roll 15 from the nozzle 16, thereby allowing the tape 14 to tightly cover the outer peripheral surface of the tape roll 15 and preventing the air from being caught into a space of the tape 14.

At that time, the winder 200 measures the distance between the nozzle 16 and the outer peripheral surface of the tape roll 15 by the displacement gage 230 and the like and, according to this measurement value, drives the linear motor 224 and the voice coil motor 226, and moves the nozzle 16 so that the distance between the nozzle 16 and the outer peripheral surface of the tape roll 15 is kept constant. That is, according to an actual measurement value of the distance between the nozzle 16 and the outer peripheral surface of the tape roll 15, the nozzle 16 is subjected to a high speed movement and a long displacement movement and, therefore, the distance between the nozzle 16 and the outer peripheral surface of the tape roll 15 can be precisely controlled.

At the time of moving the nozzle 16, for the variable component of the high frequency from among the measurement data of the displacement gage 230, the nozzle 16 is moved by using the voice coil motor 226 and, for the variable component of the low frequency, the nozzle 16 is moved by using the linear motor 224. Hence, either for a large fluctuation of the frequency or for a small fluctuation of the frequency of the measurement data, the distance between the nozzle 16 and the outer peripheral surface of the tape roll 15 can always be controlled constant. For example, with respect to a distance variation of the high frequency generated by the eccentricity of the tape roll 15, by using a voice coil motor 126, the nozzle 16 is moved. In this way, the distance between the nozzle 16 and the outer peripheral surface of the tape roll 15 can always be kept constant.

In this way, according to the winder 200 of the present embodiment, the distance between the nozzle 16 and the outer peripheral surface of the tape roll 15 is measured by the displacement gage 230 and, according to the measurement result, the nozzle 16 is moved forward or backward with respect to the outer peripheral surface of the tape roll 15, so that the distance between the nozzle 16 and the outer peripheral surface of the tape roll 15 can always be kept constant. Hence, a constant pressure can always be given to the outer peripheral surface of the tape roll 15, and the tape 14 can be wound with an adequate winding tightness.

Further, according to the winder 200, the measurement data of the displacement gage 230 is divided into the variable component of the high frequency and the variable component of the low frequency and, with respect to the variable component of the high frequency, the nozzle 16 is moved by the voice coil motor 226 and, with respect to the variable component of the low frequency, the nozzle 16 is moved by the linear motor 224 and, therefore, the follow-up property of the nozzle 16 for the outer peripheral surface of the tape roll 15 can be improved.

Note that, though the above-described embodiment uses the voice coil motor 226 as a high frequency motor, an actuator as represented by, for example, a laminated piezo actuator may be used, which precisely moves the nozzle 16 with a short cycle. Further, if the linear motor 224, which can be followed by a precise and high response frequency, is used, the voice coil motor 226 may be not used.

Further, though the above-described embodiment uses the nozzle 16 having an opening in a slit shape, the shape of the nozzle 16 is not limited to this. For example, plurality of a nozzle (not shown) in which a round hole opening is formed may be provided in the width direction of the tape 14.

As described above, the space between the nozzle 16 (air press head) and the tape roll 15 is controlled to a predetermined short distance, thereby making it possible to wind the tape 14 with a uniform winding tightness without depending on the winding diameter of the tape roll 15 and the winding speed of the tape 14. Further, by controlling the space (gap) between the nozzle 16 and the tape roll 15, the air pressure and the pressing force, the contact between the nozzle 16 and the tape 14 is prevented, thereby making it possible to prevent a trouble of damaging the tape 14.

Further, even in the case where the nozzle 16 and the tape 14 are brought into contact by any chance, by detecting the contact between the nozzle 16 and the tape 14, it is possible to discontinue the winding of the tape 14 or specify a damaged portion of the tape 14.

As described above, according to the tape winder according to the present invention, since the nozzle is supported slidably with respect to the outer peripheral surface of the tape roll, and the nozzle is pressed toward the outer peripheral surface of the tape roll with a constant pressing force, the nozzle can always be kept at a constant distance from the outer peripheral surface of the tape roll and the tape can be wound with an adequate winding tightness.

Further, according to the tape winder according to the present invention, since the tape position control device is provided, the edges of the wound tape can be neatly aligned and, at the same time, the winding tightness can be made uniform in the width direction of the tape. In this way, the tape roll having a good winding shape and no winding collapse can be formed.

Further, according to the tape winder according to the present invention, since the distance between the nozzle and the outer peripheral surface of the tape roll is measured and, according to this measurement value, the nozzle is moved, the distance between the nozzle and the outer peripheral surface of the tape roll can always be controlled constant. Hence, a constant pressing force can be applied to the outer peripheral surface of the tape roll and, therefore, the tape can be wound with an adequate winding tightness.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A tape winder, comprising:

a winding shaft which winds a tape to form a tape roll;

a nozzle which blows a gas toward an outer peripheral surface of the tape roll at a winding time of the tape;

a support device which movably supports the nozzle forward and backward with respect to the outer peripheral surface of the tape roll; and a pressing device which presses the nozzle supported by the support device toward the outer peripheral surface of the tape roll with a constant pressing force, wherein the tape is wound at a position in which a pressing force of the pressing device and a repulsive force in a space between the nozzle and the tape roll are balanced.

2. The tape winder according to claim 1, wherein the pressing device comprises an air cylinder.

3. The tape winder according to claim 1, further comprising a damping device which controls a vibration of the nozzle.

4. The tape winder according to claim 3, wherein:

the damping device comprises a conductive plate and a magnet;

one of the conductive plate and the magnet is provided to move with the nozzle, and the other of the conductive plate and the magnet is fixed adjacent to the one of the conductive plate and the magnet provided to move with the nozzle; and an eddy current is generated in a space between the conductive plate and the magnet with a forward and backward movement of the nozzle so as to control the vibration of the nozzle.

5. The tape winder according to claim 4, wherein a damping by the eddy current is not less than 0.7 in an attenuation ratio.

6. The tape winder according to claim 3, wherein:

the pressing device comprises an air cylinder;

the damping device comprises apertures provided in an air inflow port and an air exhaust port of the air cylinder; and the vibration of the nozzle is controlled by a resisting force at a time when the air passes through the apertures.

7. The tape winder according to claim 3, wherein the damping device controls the vibration of the nozzle by adjusting a frictional force at a time when the nozzle moves.

8. The tape winder according to claim 1, wherein the pressing device comprises a linear motor of a voice coil type.

9. The tape winder according to claim 1, wherein the pressing device comprises a motor which is connected to the nozzle through a gear, the nozzle being pressed by controlling the motor.

10. The tape winder according to claim 1, further comprising a tape position control device which controls a width direction position of the tape to be wound, the tape position control device being provided in an upstream side vicinity of the nozzle with respect to a winding direction of the tape.

11. The tape winder according to claim 10, further comprising a control device for the tape position control device which keeps a constant distance between the tape position control device and the outer peripheral surface of the tape roll.

12. The tape winder according to claim 11, wherein the control device for the tape position control device comprises:

a moving device which moves the tape position control device forward and backward with respect to the outer peripheral surface of the tape roll;

a distance sensor for measuring a distance between the tape position control device and the outer peripheral surface of the tape roll; and a driving device which drives the moving device according to a measurement value outputted from the distance sensor.

13. The tape winder according to claim 10, wherein:

the tape position control device comprises a hollow wrap member in which the wound tape is wrapped and an interior thereof is supplied with a gas; and a wrap surface of the wrap member is formed with a number of blowout holes blowing the gas having a hole diameter of not more than 0.3 mm.

14. The tape winder according to claim 13, wherein the hole diameter of the blowout hole of the wrap member is made larger according as it goes from both ends of the wrap member along a wrap member width direction corresponding to the tape width direction to a center portion of the wrap member.

15. The tape winder according to claim 13, wherein the hole diameter of the blowout hole of the wrap member is made larger according as it goes from both ends of the wrap member along a wrap member width direction corresponding to the tape width direction to a center portion of the wrap member.

16. The tape winder according to claim 10, wherein the tape position control device comprises a crown roller.

17. A tape winder, comprising:

a winding shaft which winds a tape to form a tape roll;

a nozzle which blows a gas toward an outer peripheral surface of the tape roll at a winding time of the tape; and a tape position control device which controls a width direction position of the tape to be wound, the tape position control device being provided in an upstream side vicinity of the nozzle with respect to a winding direction of the tape.

18. The tape winder according to claim 17, further comprising a control device for the tape position control device which keeps a constant distance between the tape position control device and the outer peripheral surface of the tape roll.

19. The tape winder according to claim 18, wherein the control device for the tape position control device comprises:

a moving device which moves the tape position control device forward and backward with respect to the outer peripheral surface of the tape roll;

a distance sensor for measuring a distance between the tape position control device and the outer peripheral surface of the tape roll; and a driving device which drives the moving device according to a measurement value outputted from the distance sensor.

20. The tape winder according to claim 17, wherein:

the tape position control device comprises a hollow wrap member in which the wound tape is wrapped and an interior thereof is supplied with a gas; and a wrap surface of the wrap member is formed with a number of blowout holes blowing the gas having a hole diameter of not more than 0.3 mm.

21. The tape winder according to claim 17, wherein the tape position control device comprises a crown roller.

22. The tape winder according to claim 17, further comprising a control device for the nozzle which keeps a constant distance between the nozzle and the outer peripheral surface of the tape roll.

23. A tape winder, comprising:

a winding shaft which winds a tape to form a tape roll;

a nozzle which blows a gas toward an outer peripheral surface of the tape roll at a winding time of the tape;

a moving device which moves the nozzle in forward and backward directions with respect to the winding shaft;

a distance sensor which measures a distance between the nozzle and the outer peripheral surface of the tape roll; and a control device which controls the moving device according to measurement values outputted from the distance sensor so that the distance between the nozzle and the outer peripheral surface of the tape roll is kept constant.

24. The tape winder according to claim 23, wherein the moving device comprises:

a voice coil motor which moves the nozzle; and a linear motor which moves the nozzle and the voice coil motor, wherein the nozzle is moved by the voice coil motor with respect to a variable component of a high frequency from among the measurement values outputted from the distance sensor, and the nozzle is moved by the linear motor with respect to a variable component of a low frequency from among the measurement values outputted from the distance sensor.

25. The tape winder according to claim 23, further comprising a tape position control device which controls a width direction position of the tape to be wound, the tape position control device being provided in an upstream side vicinity of the nozzle with respect to a winding direction of the tape.

* * * * *